US006501916B2

(12) United States Patent
Suzuki

(10) Patent No.: US 6,501,916 B2
(45) Date of Patent: Dec. 31, 2002

(54) IMAGE FORMING APPARATUS

(75) Inventor: Hideaki Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/866,701

(22) Filed: May 30, 2001

(65) Prior Publication Data

US 2002/0025178 A1 Feb. 28, 2002

(30) Foreign Application Priority Data

May 31, 2000 (JP) ..... 2000-163668

(51) Int. Cl.[7] ..... G03G 15/02; G03G 15/10

(52) U.S. Cl. ..... 399/30; 399/62; 399/175; 399/58; 399/59

(58) Field of Search ..... 399/27, 29, 30, 399/58, 59, 61, 62, 63, 149, 150, 175, 176; 430/56, 57

(56) References Cited

U.S. PATENT DOCUMENTS

| | | | | |
|---|---|---|---|---|
| 5,424,812 A | | 6/1995 | Kemmochi et al. | |
| 5,606,401 A | | 2/1997 | Yano | |
| 5,610,696 A | | 3/1997 | Kemmochi et al. | 399/285 |
| 5,655,185 A | | 8/1997 | Hori et al. | 399/138 |
| 6,052,545 A | * | 4/2000 | Komiya et al. | 399/61 |
| 6,292,640 B1 | * | 9/2001 | Suzuki | 399/175 |

FOREIGN PATENT DOCUMENTS

| | | |
|---|---|---|
| JP | 7-5748 | 1/1995 |
| JP | 2000-321833 | 11/2000 |
| JP | 2001-22174 | 1/2001 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus has a plurality of image forming devices for forming images in different colors. Each image forming device has an image bearing member, a charging device for charging the image bearing member, a developing device for developing an electrostatic latent image formed on the image bearing member by a developer containing toner and a carrier, and a detecting device for detecting information corresponding to the permeability of the developer in the developing device. The apparatus also has a control device for controlling the amount of the developer supplied to each developing device according to an output from the detecting device and a corresponding target value. Each charging device has magnetic particles which are brought into contact with the image bearing member. The permeability of the magnetic particles is different from the permeability of the carrier. The apparatus also has a correcting device for correcting each of the target values. The amount of correction by the correcting device is different with respect to the case of correcting a first target value and the case of correcting a second target value.

28 Claims, 16 Drawing Sheets

IMAGE FORMING APPARATUS

BACKGROUND OF THE INVENTION

1. Field of the Invention

The present invention relates to an image forming apparatus using an electrophotographic system or an electrostatic recording system and, more particularly, to an image forming apparatus such as a copying machine, printer, or a facsimile machine.

2. Related Background Art

Conventionally, a two-component developer having toner and carrier particles as main components are used in developing devices provided in image forming apparatuses using an electrophotographic system or an electrostatic recording system. It is preferred from the viewpoint of image hues or tones that a two-component developer should be used, in particular, in a color image forming apparatus for forming a full-color or multicolor image by an electrophotographic system. As is well known, the density of toner (i.e., the proportion of the weight of toner particles to the total weight of carrier and toner particles) of a two-component developer is a particularly important factor in stabilizing image quality. Toner particles in a developer are consumed during development to change the toner density in a developing device (developing container) and there is, therefore, a need to perform toner density control for maintaining the toner density in a suitable range to ensure the desired image quality. For this control, a toner density controller (automatic toner replenisher (ATR)) is used which accurately detects at suitable intervals the density of the developer (toner) provided in the developing device and supplies toner according to a change in the toner density.

Various methods have been proposed and put to practical use as a method for detecting the toner density in a developing device and a method for controlling the developer density for the purpose of correcting a change in toner density due to consumption during development, i.e., for controlling the amount of toner supplied to a developing device.

For example, a method (1) is known which uses a toner density controller having a detection means arranged close to a development sleeve ordinarily used as a developer bearing member or a developer transport path in a developing container to detect an amount of a developer on the development sleeve or light reflected by a developer in the developing container when the developer is irradiated with light. The toner density controller detects and controls the toner density by utilizing a phenomenon in which the intensity of reflected light changes depending on the toner density.

A method (2) is also known which uses an inductance detection type of toner density controller having an inductance head provided on, for example, a side wall portion of a developing container as an inductance sensor for detecting the apparent permeability according to the mixture ratio of a magnetic carrier and a nonmagnetic toner and for converting the apparent permeability into an electrical signal. The actual toner density in the developer in the developing container is detected through the detection signal from the inductance head and is compared with a reference value, and toner is supplied according to the result of this comparison.

Further, a method (3) is known in which the density of a patch image formed on a cylindrical electrophotographic photosensitive member, i.e., a photosensitive drum, ordinarily used as an image bearing member is detected by using a light source provided at such a position opposite to the surface of the photosensitive drum and a sensor for receiving light reflected from the surface. A signal representing the patch image density is converted into a digital signal. by an analog-to-digital converter, and the digital signal is supplied to a central processing unit (CPU) and compared with an initial set value by the CPU. If the density is higher than the initial set value, supply of toner is stopped until the density becomes equal to the initial set value. If the density is lower than the initial set value, forced toner supply is continued until the density becomes equal to the initial set value. The toner density is thus controlled indirectly to be maintained at the desired value.

Methods in which the density of toner is detected from the reflectivity of a developer transported onto a development sleeve or contained in a developing container while the developer is being irradiated with light, as in the above-described method (1), entail a problem that accumulation of a contaminant, e.g., scattered toner on the detection means reduces the accuracy with which the toner density is detected. Methods in which the toner density is indirectly controlled through the density of a patch image, as in the above-described method (3), entails a problem that the difficulty in securing the space for formation of the patch image and the space for placement of the detection means is increased with the reduction in size of image forming apparatuses designed as copying machines or the like.

In contrast, inductance detection methods, typified by the above-described method (2), are considered to be most effective in realizing an image forming apparatus designed as a space-saving type manufactured at a low cost, because the sensor unit is low priced and because they are free from the problem of contamination of a detection means due to scattering of toner and the space problem described above with respect to the methods (1) and (3).

The inductance detection type of toner density controller (inductance detection type of ATR) controls the toner density on the basis of a control method such that, when it is determined as a detection result that the apparent permeability of the developer is large, supply of toner is started because the detection result signifies that the toner density has become lower while the proportion of the volume occupied by carrier particles in a certain volume of the developer has been increased, and that, when the apparent permeability is reduced, supply of toner is stopped because the detection result signifies the toner density has become higher while the proportion of the volume occupied by carrier particles in the certain volume of the developer has been reduced.

On the other hand, corona chargers have generally been used as charging means (charging device) for charging an image bearing member such as an electrophotographic photosensitive member or an electrostatic recording dielectric member in electrophotographic type or electrostatic recording type of image forming apparatuses. In recent years, however, contact-type charging devices, i.e., charging devices based on a method of charging a member to be charged with electricity (hereinafter referred to as a "charged member") by bringing a charging member, to which a voltage is applied, into contact with the charged member, have been put to practical use because of their advantage of limiting generation of ozone and power consumption. In particular, charging devices of a roller charging type having a charging roller as a charging member are preferred by considering charging stability and are being advantageously used.

In the charging system using the roller charging type of charging device, however, the electrical resistances of the charging roller and the image bearing member change under the influence of environmental changes since charging is performed by discharge from the charging member to the charged member, resulting in variation in the surface potential of the image bearing member.

A charging method which reduces the influence of environmental changes, e.g., the one described in Japanese Patent Application Laid-Open No. 7-5748, which is a counterpart of U.S. Pat. No. 5,606,401, has recently been proposed in which a photosensitive member having a charge injection, layer formed in its surface and a conductive powder ($SnO_2$ or the like) for a trap level dispersed in the charge injection layer is charged in a contact charging manner through an electroconductive contact-type charging member (a charging fur brush, a charging electromagnetic brush, a charging roller, or the like) to which a voltage is applied to inject charge into the: photosensitive member with the same polarity as the potential of the same.

This injection charging method does not use discharge and therefore has the advantage of limiting the applied voltage to a level not significantly different from the potential of the photosensitive member and avoiding generation of ozone which reduces the life of the photosensitive member, as well as the advantage of reducing the environment dependence.

In the case of contact charging using discharge, in order to enable the charged member to have the desired charging potential Vs, it is necessary to apply to the charging member a voltage determined by adding a discharge initiation voltage Vth (a voltage applied to the contact-type charging member when a dc voltage is applied to the contact-type charging member to start charging the charged member) to the desired charging potential Vs, i.e., a dc bias Vs+Vth. In contrast, in charge-injection charging, the charging potential Vs can be obtained as substantially the same potential as the dc bias applied to the charging member, so that the charging power source can be provided at a reduced cost.

As a contact-type charging member in such a charge injection system, a magnetic brush type of charging member or a fur brush type of charging member is preferably used by considering charging stability, contact stability, etc.

The magnetic brush type of charging member has a magnetic brush (charging magnetic brush) formed by magnetically binding conductive magnetic particles (hereinafter referred to as "charging carrier") on a supporting portion, which is also used as a feeder electrode. The charging magnetic brush is brought into contact with the charged member and a voltage is applied to the supporting portion. More specifically, the magnetic-brush-type charging member is formed in such a manner that charging carrier is magnetically bound directly on a magnet or on a sleeve containing a magnet, provided as a supporting portion, so as to form a magnetic brush in which the charging carrier stands like the ears of rice. The magnetic brush portion of this magnetic-brush-type charging member is brought into contact with the charged member while the charging member is stopped or being rotated, and a voltage is simultaneously applied to the charging member, thereby charging the charged member.

The fur-brush-type charging member has a brush portion (fur brush portion) formed by conductive fibers supported on a supporting portion, which is also used as a feeder electrode. The conductive fiber brush portion is brought into contact with the charged member and a voltage is applied to the supporting portion.

The charging performance of the fur-brush-type charging member becomes poor if its fibers are flattened during long-time use or long-term shelving. Also, the charging uniformity is liable to lower due to a restriction on the brush fiber diameter, etc. In contrast, the magnetic-brush-type charging member is free from the occurrence of the above-described phenomena relating to the fur-brush-type charging member and is capable of uniform and stable charging.

However, image forming apparatuses having a magnetic-brush-type charging device using the above-described magnetic-brush-type charging member have problems described below.

That is, during use of the magnetic-brush-type charging device, there is a possibility of the charging carrier in the magnetic brush portion of the magnetic-brush-type charging member flowing out by being attached to the image bearing member, e.g., a photosensitive drum. In the case of a developing device which controls the toner density with an inductance detection type of toner density controller, if the charging carrier attached to the image bearing member to flow out is collected in the developing device, it is gradually accumulated in the developing device as the image forming operation is repeated, although the amount of the charging carrier attached to the photosensitive drum to flow out may initially be not so large as: to immediately influence the quality of images formed by the image forming apparatus. If magnetic particles (hereinafter referred to as "developing carrier") used in the developing device and the charging carrier differ in permeability, the apparent permeability of the developer as a whole may change to cause an error in toner density control performed by the inductance detection type of toner density controller.

That is, if the permeability of the charging carrier is larger than that of the developing carrier, mixing of the charging carrier into the two-component developer in the developing device causes the inductance sensor to output a detection result indicating an increase in the average permeability of the developer even when the toner density in the developing container is constant. This detection result corresponds to the case where the proportion of the carrier particles in a certain volume of the developer is increased and the toner density is reduced, and supply of toner is then started. In this case, the result of density control is that the toner density is higher than the correct toner density value.

Conversely, if the permeability of the charging carrier is smaller than that of the developing carrier, mixing of the charging carrier into the two-component developer in the developing device causes the inductance sensor to output a detection result indicating a reduction in the average permeability of the developer even when the toner density in the developing container is constant. This detection result corresponds to the case where the proportion of the carrier particles in a certain volume of the developer is reduced and the toner density is increased, and the inductance detection type of ATR stops supply of toner. In this case, the result of density control is that the toner density is lower than the correct toner density value.

In the former case, an excessive supply of toner results in an excessively high image density, and there are other problems stemming therefrom: a problem of the developer increased in total amount with the increase in the amount of toner flowing out of the developing container, and a problem of the possibility of scattering of toner being increased by a reduction in the amount of charge on toner with the increase in the proportion of toner in the developer. In the latter case, a reduction in the amount of toner in the developer results in a deterioration in image quality, a considerable reduction in image density, etc. These problems may become more serious as the image forming process is repeated over many times.

Studies made by the inventor of the present invention have revealed that in the case of an image forming apparatus arranged to form an image by using a plurality of developing devices, the amount of charging carriers attached to photosensitive drums varies depending upon a characteristic of developers respectively used in the developing devices (e.g., the amount of charge per unit toner weight) and upon environmental conditions (temperature, humidity) under which the developing devices are used.

For example, in the case of an image forming apparatus which forms a toner image by using developing devices for processing on a plurality of photosensitive drums, toner remaining on the photosensitive drum without being transferred to a recording member in each transfer section, i.e., transfer residue toner, can mix in a component of the magnetic-brush-type charging member of the charging device. The resistance of the magnetic-brush-type charging member is thereby increased to reduce the efficiency of charge injection from the magnetic-brush-type charging member into the photosensitive drum surface layer. In such a situation, the charging carrier can be easily attached to the photosensitive drum to flow out.

The efficiency of transfer of toner images formed on the photosensitive drums to the recording member varies slightly depending upon the developing devices (the characteristics of the developers (the above-mentioned toner charge amount), etc.) and the transfer device. Consequently, the amount of toners remaining on each photosensitive drum varies, so that the amounts of the charging carriers attached to the photosensitive drums and flowing out is different in each of the image forming sections (developing devices).

Further, the resistances of the charging carrier and the photosensitive drum are also increased under a low-humidity condition to cause a reduction in the efficiency of charge injection from the charging carrier to the photosensitive drum surface layer (the surface layer for injection charging), such that the charging potential of the photosensitive drum surface layer is lower than the bias applied to the charging device. A potential difference is thereby caused between the charging carrier tips and the photosensitive drum surface layer to render the charging carrier liable to be attached to the photosensitive drum. Thus, the amount of the charging carrier attached to the photosensitive drum and flowing out varies depending upon environmental conditions.

SUMMARY OF THE INVENTION

In view of the above-described circumstances, an object of the present invention is to provide an image forming apparatus capable of optimizing the amount of a developer supplied to each of a plurality of development means even if magnetic toner particles mixes in a component of the development means.

Other objects of the present invention will become apparent upon reading the following detailed description of embodiments of the invention.

DESCRIPTION OF THE PREFERRED EMBODIMENTS

Image forming apparatuses in accordance with the present invention will be described in detail with reference to the accompanying drawings.

(Embodiment 1)

Figure 1:
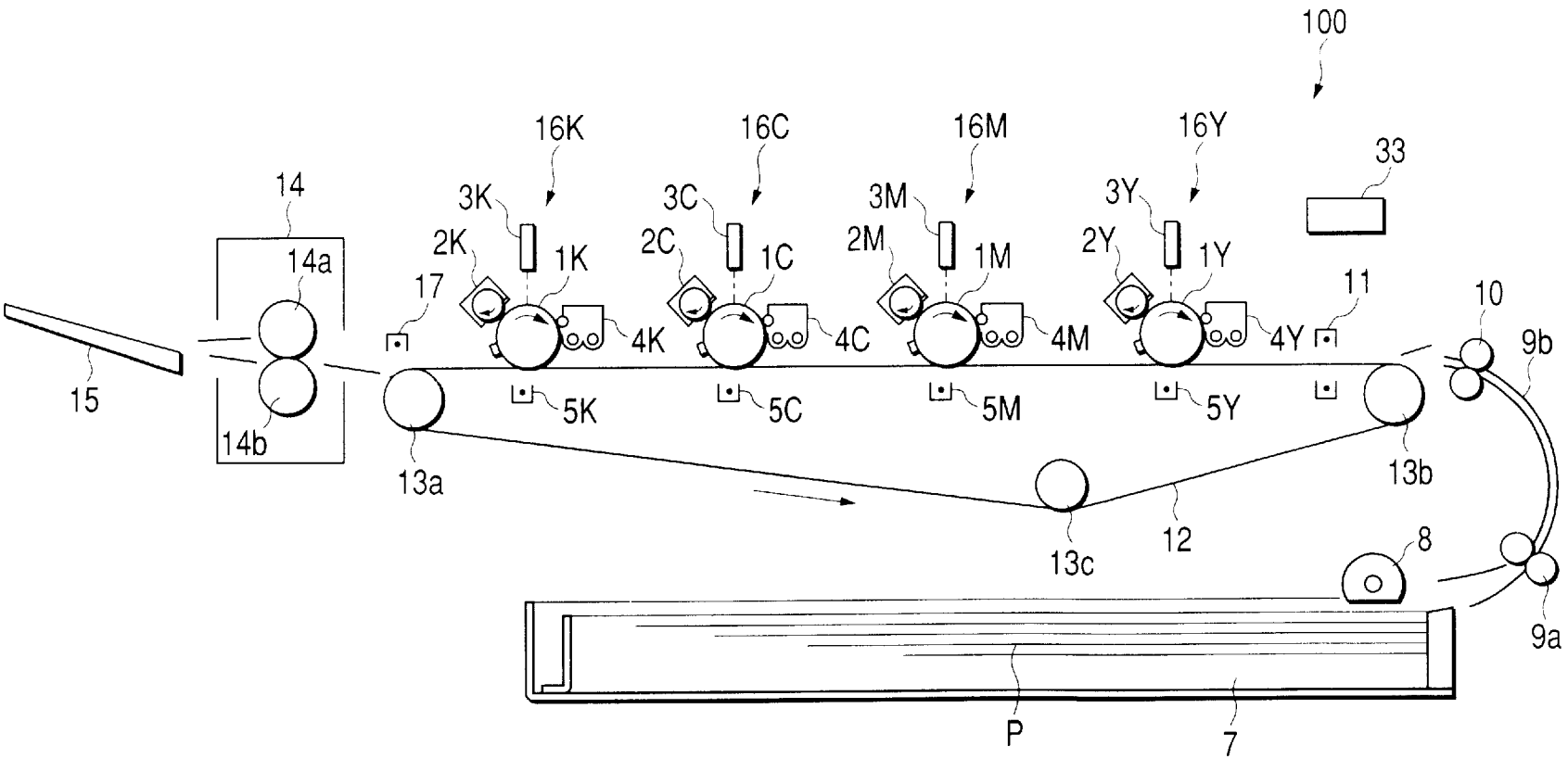
FIG. 1 is a diagram schematically showing an image forming apparatus which represents an embodiment of the present invention.

FIG. 1 schematically shows the construction of an image forming apparatus which represents an embodiment of the present invention. In this embodiment, the image forming apparatus is arranged as a color electrophotographic copying machine (hereinafter referred to simply as "image forming apparatus") 100 capable of forming a full-color image. The image forming apparatus 100 has first to fourth image forming sections (stations) 16Y, 16M, 16C, and 16K arranged in a row along a path above a transfer belt 12 provided as a recording material bearing member, and is capable of forming a full-color image at a high speed. The image forming sections 16Y, 16M, 16C, and 16K form images in yellow, magenta, cyan, and black, respectively.

The image forming operation of the image forming apparatus 100 in this embodiment will be outlined. A recording material P, e.g., recording paper contained in a recording material containing cassette 7 is conveyed by a pickup roller 8, a pair of feed rollers 9*a*, a feed guide 9*b*, etc., to reach registration rollers 10, which feed the recording material P onto the transfer belt 12 at a suitable timing for the image forming process to be performed in each of the image forming sections 16Y, 16M, 16C, and 16K. The transfer belt 12 is, for example, an endless belt formed of an insulating resin sheet looped around a drive roller 13*a*, a driven roller 13*b*, and a tension roller 13*c*. The transfer belt 12 is charged by an attracting charger 11 and bears and conveys the recording material P while electrostatically attracting the recording material P. As the recording material P is conveyed to pass the image forming sections 16Y to 16K one after another, toner images respectively formed in the image forming sections 16Y to 16K in accordance with color separation image information signals of yellow, magenta, cyan, and black images transmitted from an original reader (not shown) provided in the image forming apparatus 100 or a host computer or the like connected to the image forming apparatus 100 so as to be capable of communication with the image forming apparatus are sequentially multilayer transffered onto recording material P, as described below in detail. Recording material P having passed the fourth image forming section (black image forming section) 16K is separated from the transfer belt 12 by the action of a separation charger 17 to be fed to a thermal fixing device (heat-roller fixing device) 14 provided as a fixing means. The thermal fixing device 14 conveys recording material P while pinching the same between a fixing roller 14*a* incorporating a heating means and a drive roller 14*b*, and thermally fixes unfixed toner images on recording material P by the fixing roller 14*a*. Recording material P on which a color image is formed as described above is delivered onto a delivery tray 15 which is mounted on the apparatus body so as to project from the apparatus body.

Figure 2:
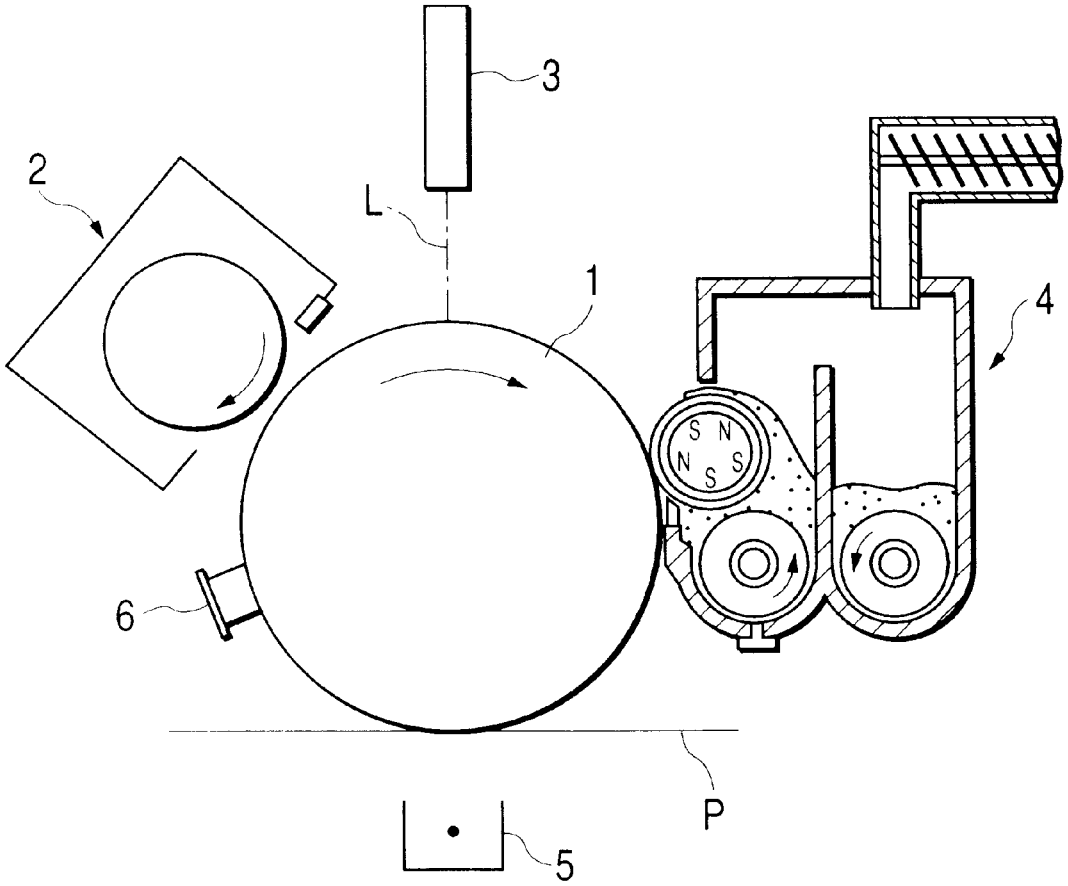
FIG. 2 is a schematic enlarged diagram of the image forming section of the image forming apparatus shown in FIG. 1.

The image forming sections 16Y, 16M, 16C, and 16K will be described with reference to FIG. 2 as well as to FIG. 1. In FIG. 2, only one image forming section is illustrated for the image forming sections 16Y, 16M, 16C, and 16K, which are generally identical to each other in construction.

Each of the image forming sections 16Y, 16M, 16C, and 16K has a cylindrical electrophotographic photosensitive member as an image bearing member capable of rotating in the direction indicated by the arrow, i.e., a photosensitive drum 1, and image forming means disposed around the photosensitive drum 1. The image forming means includes a magnetic-brush-type charging device 2 provided as a charging means, an exposure means 3 constituted by a laser beam scanner provided as a means for forming an electrostatic latent image on the photosensitive drum 1 and placed above the photosensitive drum 1 as viewed in FIG. 2, a developing device 4, and a transfer charger 5 provided as a transfer means.

In the following description, suffixes Y, M, C, and K respectively denoting yellow, magenta, cyan and black are attached to reference numerals for the means and members belonging to the image forming sections 16Y, 16M, 16C, and 16K in particular to enable discrimination therebetween, as is Y in yellow developing device 4Y, for example.

An image forming process performed in each of the image forming sections 16Y to 16K will be described. First, the photosensitive drum 1 is uniformly charged by the magnetic-brush-type charging device 2. The photosensitive drum 1 rotates in the direction of the arrow (clockwise) at a processing speed (peripheral speed) of 150 mm/sec.

The surface of the photosensitive drum 1 is exposed in a scanning manner to laser light L modulated with an image signal to form an electrostatic latent image on the photosensitive drum 1. For example, the original reader (not shown) having a photoelectric conversion device, such as a charge-coupled device (CCD), outputs image information signals corresponding to image information on an original image, and a semiconductor laser device incorporated in the laser beam scanner in the exposure means 3 of each image forming section is controlled according to the corresponding color-separated original image information signal to emit modulated laser beam L.

The electrostatic latent image formed on the photosensitive drum 1 is electrostatically reversal-developed by the developing device 4 to form a visible image, i.e., a toner image, as the photosensitive drum 1 rotates.

In this embodiment, the developing device 4 uses a two-component developer in which a nonmagnetic toner and a magnetic carrier (developing carrier) are mixed. More specifically, a two-component contact development system is used in which a magnetic brush for development is brought into contact with the surface of the photosensitive drum 1 to electrostatically transfer toner to latent image portions. This system is preferred from the viewpoint of image hues or tones and makes it possible to improve collection of toner released from the magnetic-brush-type charging device 2 in the image forming apparatus of this embodiment using a cleanerless collection system in which transfer residue toner remaining on each photosensitive drum is collected by the developing device.

The toner image formed on the photosensitive drum 1 is electrostatically transferred by the action of the transfer charger (corona charger) 5 to recording material P conveyed via the pickup roller 8, the pair of feed rollers 9 and the feed guide 9*b* by being borne on the transfer belt 12. Transfer residue toner remaining on the surface of the photosensitive drum 1 without being transferred to recording material P is temporarily collected by the magnetic-brush-type charging device 2.

Thereafter, charge on the photosensitive drum 1 is eliminated by a conductive brush 6 which is provided as a charge eliminating means and brought into contact with the photosensitive drum 1, and to which an ac bias and a dc bias having a polarity opposite to a normal charging polarity of the toner, or a bias provided by superimposing an ac bias and a dc bias having a polarity opposite to a normal charging polarity of the toner is applied.

The above-described process is performed in each of the image forming sections 16Y to 16K with respect to the color-separated images in four colors: yellow, magenta, cyan, and black, thereby obtaining a full-color image on the recording material.

In this embodiment, the photosensitive drum 1 is used as an image bearing member. However, the present invention is not limited to this, and an electrophotographic photosensitive member formed as an endless belt, i.e., a photosensitive belt, for example, may alternatively be used. Also, in this embodiment, a collection system is adopted in which transfer residue toner is temporarily collected by the magnetic-brush-type charging device 2 is then released onto the photosensitive drum 1 to be collected by the developing device 4. Needless to say, the present invention is not limited to this and the arrangement may alternatively be such that transfer residue toner released from the magnetic-brush-type charging device 2 onto the photosensitive drum 1 is collected by using a cleaning device having a cleaning means conventionally used widely, i.e., a device constituted by a blade-like member to be brought into contact with the photosensitive drum 1 to scrape off transfer residue toner.

The photosensitive drum 1 used in this embodiment will next be described.

The photosensitive drum 1 in this embodiment is an OPC (organic photoconductor) photosensitive member to be negatively charged, in which first to fifth functional layers described below are provided in the order from a bottom to a top layers on a base member in the form of a drum having a diameter of ϕ30 mm and made of aluminum.

The first layer is an electroconductive undercoat layer having a thickness of about 20 μm. The layer is provided for the, purpose of leveling the surface of the aluminum drum base member (hereinafter referred to as "aluminum base member") so as to make defects or the like in the aluminum base member negligible and for the purpose of preventing occurrence of moire due to reflection at the time of laser exposure.

The second layer is a positive charge blocking layer having the function of preventing positive charge injected from the aluminum base member from canceling out negative charge supplied to the surface of the photosensitive member. The second layer is a medium-resistance layer having a thickness of about 1 μm, and the resistance of this layer is adjusted to about $10^6$ Ω·cm by using Amilan resin and methoxymethylated nylon.

The third layer is a charge generation layer having a thickness of about 0.3 μm and formed of a resin in which a diazo-based pigment is dispersed. The third layer generates positive-negative dipolar charges when undergoing laser exposure.

The fourth layer is a charge transport layer formed of a polycarbonate resin in which a hydrazone is dispersed, and this layer is a p-type semiconductor. Accordingly, negative charge supplied to the surface of the photosensitive member cannot move across this layer and only positive charge generated in the charge generation layer can be transported to the photosensitive member surface.

The fifth layer is a charge injection layer for achieving injection charging with the magnetic-brush-type charging device. The layer is formed as a coating layer having a thickness of about 3 μm by dispersing 70 wt % of ultrafine tin oxide particles having a particle diameter of 0.03 μm in a photo-setting acrylic resin provided as a binder. The tin oxide particles are prepared by being doped with antimony provided as a light-transmitting electroconductive filler to reduce the resistance (to become electroconductive). Preferably, the electrical resistance value (volume resistivity) of this charge injection layer is set to $1\times10^{10}$ to $1\times10^{14}$ Ω·cm to ensure sufficiently high injection charging performance and to prevent occurrence of a smeared image, i.e., an image defect due to failure to correctly form a latent image. In this embodiment, a photosensitive drum having a surface resistance of $1\times10^{11}$ Ω·cm was used.

The magnetic-brush-type charging device 2 used in this embodiment will be described with reference to FIG. 3. The image forming apparatus of this embodiment uses the magnetic-brush-type charging device 2 (hereinafter referred to simply as "charging device") as a means for charging the surface of the photosensitive drum 1. The charging device 2 performs charge-injection charging.

The charging device 2 has a container 20, a charging sleeve 22 provided as a charging magnetic particle bearing member, made of a nonmagnetic material, and incorporating a charging device stationary magnet 21 as a magnetic field generating means, charging elecroconductive magnetic particles (charging carrier) 23 to be brought into contact with the photosensitive drum 1 to inject charge into the same, and a charging carrier regulating blade 24 provided as a charging magnetic particle layer thickness regulating means to form a coating of charging carrier 23 uniform in thickness on the surface of the charging sleeve 22.

Figure 3:
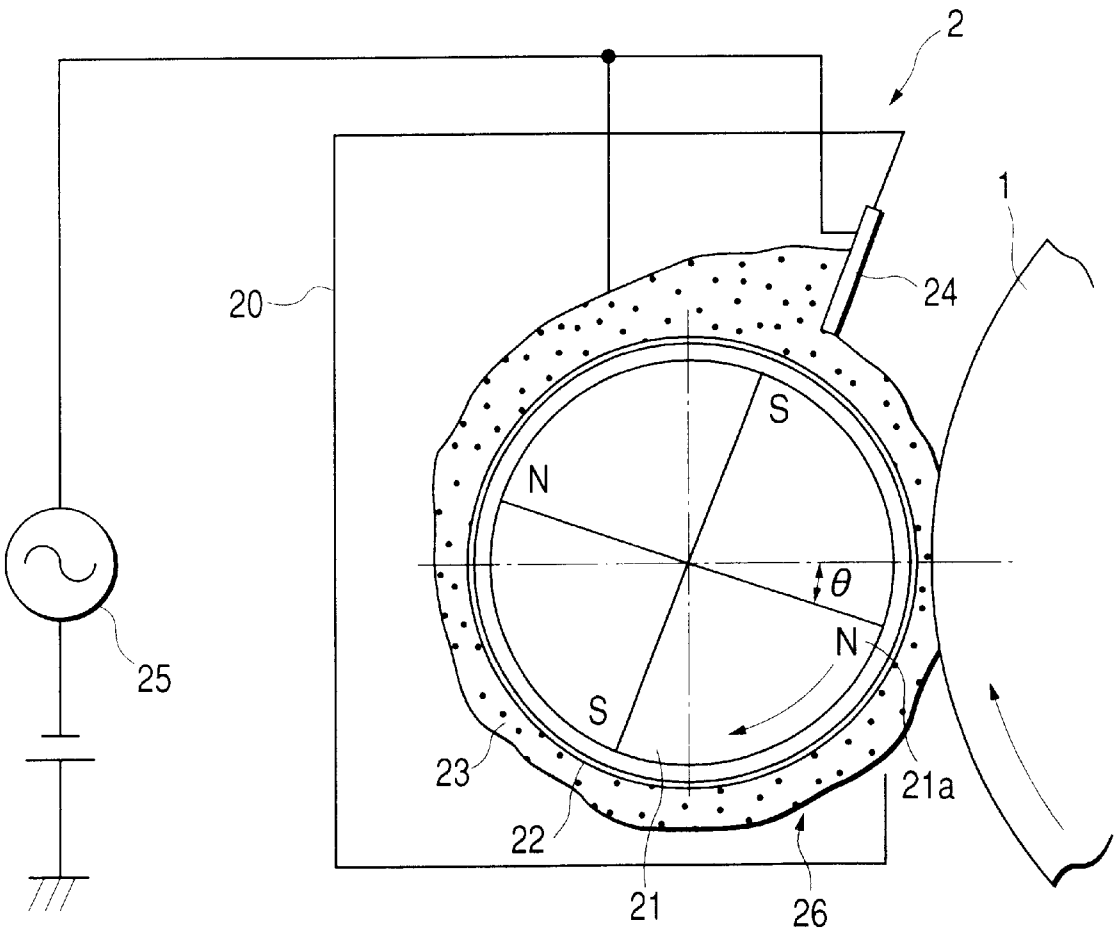
FIG. 3 is a schematic enlarged cross-sectional view of a charging device provided in the image forming section shown in FIG. 2.

The charging sleeve 22 rotates at a peripheral speed of 225 mm/sec in the same direction as the photosensitive drum 1, i.e., the clockwise direction indicated by the arrow in FIG. 3. The charging carrier regulating blade 24 is made of nonmagnetic stainless steel and is placed so that a gap of 900 μm is formed between the blade 24 and the surface of the charging sleeve 22.

The charging device stationary magnet 21 fixedly disposed inside the charging sleeve 22 has a magnetic pole (main pole) 21*a* of about 900 G (90 mT) positioned at an angle of 10° from the point at which the charging sleeve 22 and the photosensitive drum 1 are closest to each other, to the upstream side with respect to the direction of rotation of the photosensitive drum 1. Preferably, the main pole 21*a* is set so that the angle between the main pole 21*a* and the point at which the charging sleeve 22 and the photosensitive drum 1 are closest to each other, i.e., the angle which is formed between a line connecting the center point in the cross section of the charging device stationary magnet 21 concentric with the charging sleeve 22 and the point at which the charging sleeve 22 and the photosensitive drum 1 are closest to each other on the same plane, and a line connecting the center point and the main pole 21*a*, and which is indicated by Θ in FIG. 3, is within the range between 20° to the upstream side with respect to the direction of rotation of the photosensitive drum 1 and 10° to the downstream side with respect to the direction of rotation of the photosensitive drum 1. More preferably, the angle Θ is within the range between 15° and 0° to the upstream side with respect to the direction of rotation of the photosensitive drum 1. If the angle Θ is greater than 10° to the downstream side with respect to the direction of rotation of the photosensitive drum 1, charging carrier 23 is attracted to the main,pole position so as to be liable to remain on the downstream side of the region where charging carrier 23 contacts the photosensitive drum 1 at the time of charging, i.e., the charging nip, with respect to the direction of rotation of the photosensitive drum 1. Conversely, if the angle Θ is greater than 20° to the upstream side with respect to the direction of rotation of the photosensitive drum 1, the conveyability of charging carrier 23 after passing the charging nip is reduced to make charging carrier 23 liable to remain. It is evident that if the magnetic pole is remote from the charging nip, the force exerted on charging carrier 23 to retain the same on the charging sleeve 22 is so small that charging carrier 23 can be easily attached to the photosensitive drum 1.

In the charging device 2 of this embodiment, the charging bias is applied to the charging sleeve 22 and to the charging carrier regulating blade 24 by a power supply 25 for the charging device. The dc component of the charging bias is set to the same value as the desired charging potential on the surface of the photosensitive drum 1 (−700 V in this embodiment). The peak-to-peak voltage (hereinafter referred to as "Vpp") of the ac component of the charging bias is within the range from 100 to 2000 V and, particularly preferably, in the range from 300 to 1200 V. If Vpp is lower than 100 V, the effects of biasing are not sufficiently high in improving the uniformity of charging and the rise of the charging potential. If Vpp is higher than 2000 V, the problem of staying of charging carrier 23 or attachment of charging carrier 23 to the photosensitive drum 1 becomes worse.

The frequency of the ac component of the charging bias is, preferably, in the range of 100 to 5000 Hz and, particularly preferably, in the range of 500 to 2000 Hz. If the frequency is lower than 100 Hz, the problem of attachment of charging carrier 23 becomes worse, the uniformity of charging is reduced and the biasing effect in terms of rise of the charging potential is lowered. If the frequency is higher than 5000 Hz, the desired effects in improving the uniformity of charging and the rise of the charging potential,cannot be obtained.

As a waveform of the ac component, a rectangular wave, a triangular wave or a sine wave is preferred.

In this embodiment, a material prepared by processing sintered ferromagnetic material (ferrite) by a reducing process was used as charging carrier 23. Also, particles formed by kneading a resin and a ferromagnetic material powder, particles formed in this manner while mixing conductive carbon or the like in the material for resistance value control, or particles formed in a like manner and surface-treated may alternatively be used.

Charging carrier 23 must have both the function of suitably injecting charge into the surface of the photosensitive drum 1 at the trap level and the function of preventing energizing breakdown of a magnetic-brush-type charging member 26 and the photosensitive drum 1 due to concentration of charging currents at defects such as pinholes in the surface of the photosensitive drum 1. Therefore, the resistance value of the magnetic-brush-type charging member 26 is, preferably, $1\times10^4$ to $1\times10^9$ Ω·cm and, particularly preferably, $1\times10^4$ to $1\times10^7$ Ω·cm. If the resistance value of the magnetic-brush-type charging member 26 is smaller than $1\times10^4$ Ω·cm, there is a tendency that the occurrence of pinhole leaks is likely to increase. If the resistance value of the magnetic-brush-type charging member 26 is larger than $1\times10^9$ Ω·cm, there is a tendency that it becomes difficult to suitably inject charge. For control of the resistance value of the magnetic-brush-type charging member 26 within the above-described range, it is preferred that the volume resistivity of charging carrier 23 be $1\times10^4$ to $1\times10^9$ Ω·cm and, particularly preferably, $1\times10^4$ to $1\times10^7$ Ω·cm.

Also, from the viewpoint of prevention of a deterioration in charging performance due to the contamination of the particle surface, it is preferred that the average particle diameter of charging carrier 23 and a peak in a particle size distribution measurement be within the range of 5 to 100 μm.

In this embodiment, the volume resistivity of the magnetic-brush-type charging member 26 is set to $1\times10^6$ Ω·cm. The intensity of magnetization (σ1000) in a magnetic field at 1 kilo-oersted of charging carrier 23 used in this embodiment is 270 emu/cm$^2$, as described below in the detailed description of a measuring method, etc.

The thus-arranged charging device 2 charges the photosensitive drum 1 by charge-injection charging in such a manner that the magnetic-brush-type charging member 26 formed by charging carrier 23 standing on the charging sleeve 22 like the ears of rice is brought into contact with the surface of the photosensitive member 1 while being rotated, and a voltage is applied to the magnetic-brush-type charging member 26.

In the charging device 2 of this embodiment, a voltage of −700 V is applied as the dc component of the charging bias, so that the surface potential of the photosensitive drum 1 is also −700 V, thus realizing injection charging.

Figure 4:
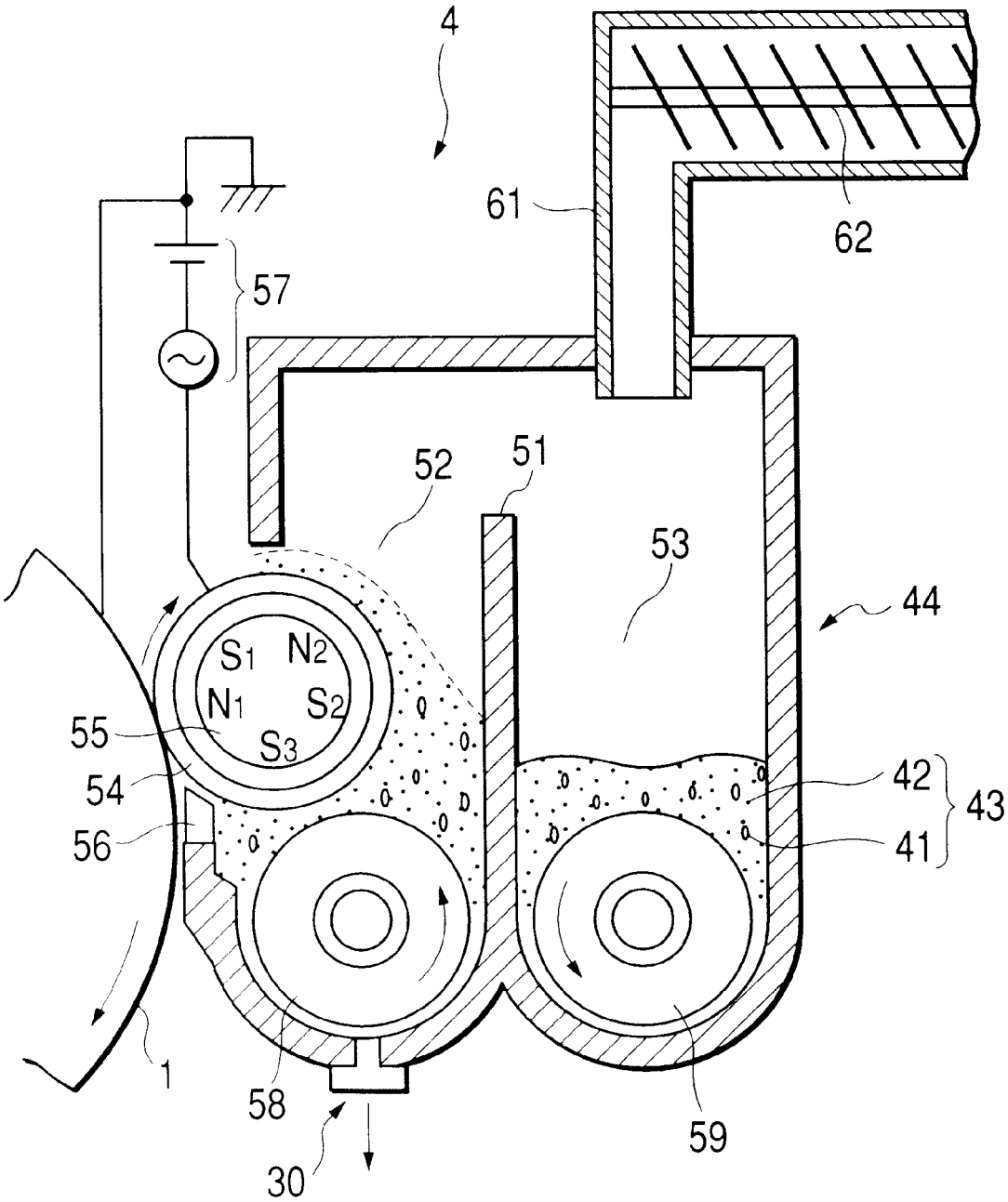
FIG. 4 is a schematic enlarged cross-sectional view of a developing device provided in the image forming section shown in FIG. 2.

The developing device 4 used in this embodiment will next be described with reference to FIG. 4. In the image forming apparatus 100 of this embodiment, a latent image formed on each photosensitive drum 1 is developed on the basis of a two-component contact development. method using a two-component developer 43 containing a developing carrier (magnetic carrier) 41 and nonmagnetic toner 42 (toner), as mentioned above. In this embodiment, the toner used has a negative polarity as a normal charging polarity.

The developing device 4 has a developing container 44 containing the two-component developer 43. The developing container 44 is placed so as to face the photosensitive drum 1 and has its entire internal region sectioned into a first chamber (developing chamber) 52 and a second chamber (agitating chamber) 53 by a partition 51 extending vertically. In the first chamber 52 is disposed a developing sleeve 54 which is a nonmagnetic sleeve provided as a developer bearing member and capable of rotating in the direction indicated by the arrow in FIG. 4. A developing device stationary magnet 55 provided as a magnetic field generating means is fixedly disposed inside the developing sleeve 54. The developing sleeve 54 bears and transports a layer of the two-component developer 43 thickness-regulated by a developer layer thickness regulating blade 56 provided as a developer layer thickness regulating means to bring a developing magnetic brush formed by two-component developer 43 standing like the ears of rice into contact with the photosensitive drum 1 in a development region where the development sleeve 54 faces the photosensitive drum 1 and to thereby supply the toner 42 to electrostatic latent image portions on the photosensitive drum 1, thus performing development. To improve the development efficiency, i.e., the efficiency of attachment of the toner 42 to the latent image, a development bias voltage provided by superimposing a dc voltage on an ac voltage is applied from a power supply 57 to the developing sleeve 54.

First and second developer agitating screws 58 and 59 are disposed in the first and second chambers 52 and 53, respectively. The first screw 58 agitates and transports the developer in the first chamber 52 while the second screw 59 agitates and transports replenishment toner 63 supplied by the rotation of a transport screw 62 through a toner discharge hole 61 of a toner replenishment tank 60 described below and the developer 43 existing in the developing container 44 to make uniform the toner density in the developing container. Developer paths (not shown) through which the first and second chambers 52 and 53 communicate with each other are formed in end portions of the partition 51 on this side and the other side of the drawing sheet of FIG. 4. The transport actions of the first and second screws 58 and 59 cause developer 43 in the first chamber 52 having a reduced toner density because of consumption of toner by development to move into the second chamber 53 through one of the developer paths, and cause developer 43 having the toner density collected in the second chamber 53 to move into the first chamber 52 through the other developer path.

The image forming apparatus 100 of this embodiment has an inductance detection type of toner density controller (hereinafter referred to simply as a "toner density controller"), as described below in detail. To enable adjustment of the toner density in the developing container 44 with this toner density controller in electrostatic latent image development, i.e., to enable control of the amount of toner supplied to the developing container 44, an inductance head 30 (detecting means)as an inductance sensor is provided on a bottom wall portion of the first chamber (developing chamber) 52 of the developing container 44. The toner density controller detects the actual toner density in the developing container 44, more specifically in the developer 43 in the first developing chamber 52 according to a detection signal (information corresponding to the permeability of the developer) supplied from the inductance head 30. The toner density controller compares the detection signal with a reference value (target value) by means of a central processing unit (CPU) (control means) 67 to determine the amount of toner supplied to the developing container 44.

In the present invention, the toner particles 42 contained in the two-component developer 43 are freely selected and are not particularly specified. For example, spherical polymer toner particles are preferably used which are made by a polymerizing method in which the monomer compound prepared by adding a coloring material and a charge control agent to a monomer is suspended in a water-based medium to be polymerized. This method is suitable for making spherical toner particles at a low cost. A toner made by a pulverizing method conventionally used widely may also be used.

As the developing carrier 41, a low-magnetized carrier may be used. Significant improvements in image qualities can be achieved by using a combination of the low-magnetized carrier and the above-described spherical polymerized toner. The inventor of the present invention has experimentally confirmed that when the intensity of magnetization ($\sigma$1000) of the developing carrier 41 in a magnetic field at 1 kilo-oersted (Oe) is 230 emu/cm$^3$ or less and when, more preferably, the intensity of magnetization is 140 emu/cm$^3$ or less while the distance (S-D gap) between the development sleeve 54 and the photosensitive drum 1 is in the range of 300 to 1000 $\mu$m; the amount of the developer on the developing sleeve 54 per unit area (hereinafter referred to as "M/S") is in the range of 15 to 50 mg/cm$^2$; and the toner density is in the range of 5 to 12%, the magnetic interaction between adjacent magnetic brush portions is sufficiently small because of the low magnetized amount, so that ear-like portions of the magnetic brush are finely formed and are suitably short in length. The magnetic brush formed under such conditions softly sweeps the latent image surface to which the toner is attached to scrape off the developer toner attached to the latent image surface, thus preventing scavenging and enabling provision of a high-resolution image.

In this embodiment, the intensity of magnetization ($\sigma$1000) of the developing carrier 41 in a magnetic field at 1 kilo-oersted is 135 emu/cm$^3$.

The above-described magnetized characteristics of the charging carrier 23 and the development carrier 41 were measured by using BHV-30, manufactured by Riken Denshi (K.K.), which is a vibrating magnetic field type of automatic magnetic characteristic recorder. Magnetic characteristics values of the carrier powders (the charging carrier 23, the developing carrier 41) are obtained by forming an external magnetic field at 1 kilo-oersted and by measuring the intensities of magnetization therein. The carriers are prepared in a state of being sufficiently densely packed in a cylindrical plastic container. The magnetizing moment is measured in this state and the actual weight in which a sample is measured, thereby obtaining the intensity of magnetization (emu/g). Then the true specific gravity of the carrier particles is obtained by using Accupyc 1330 (manufactured by Shimadzu Corporation), which is a dry-type automatic densimeter. The intensity of magnetization (emu/g) is multiplied by the true specific gravity to obtain the intensity of magnetization per unit area (emu/cm$^3$) in the present invention.

Figure 5:
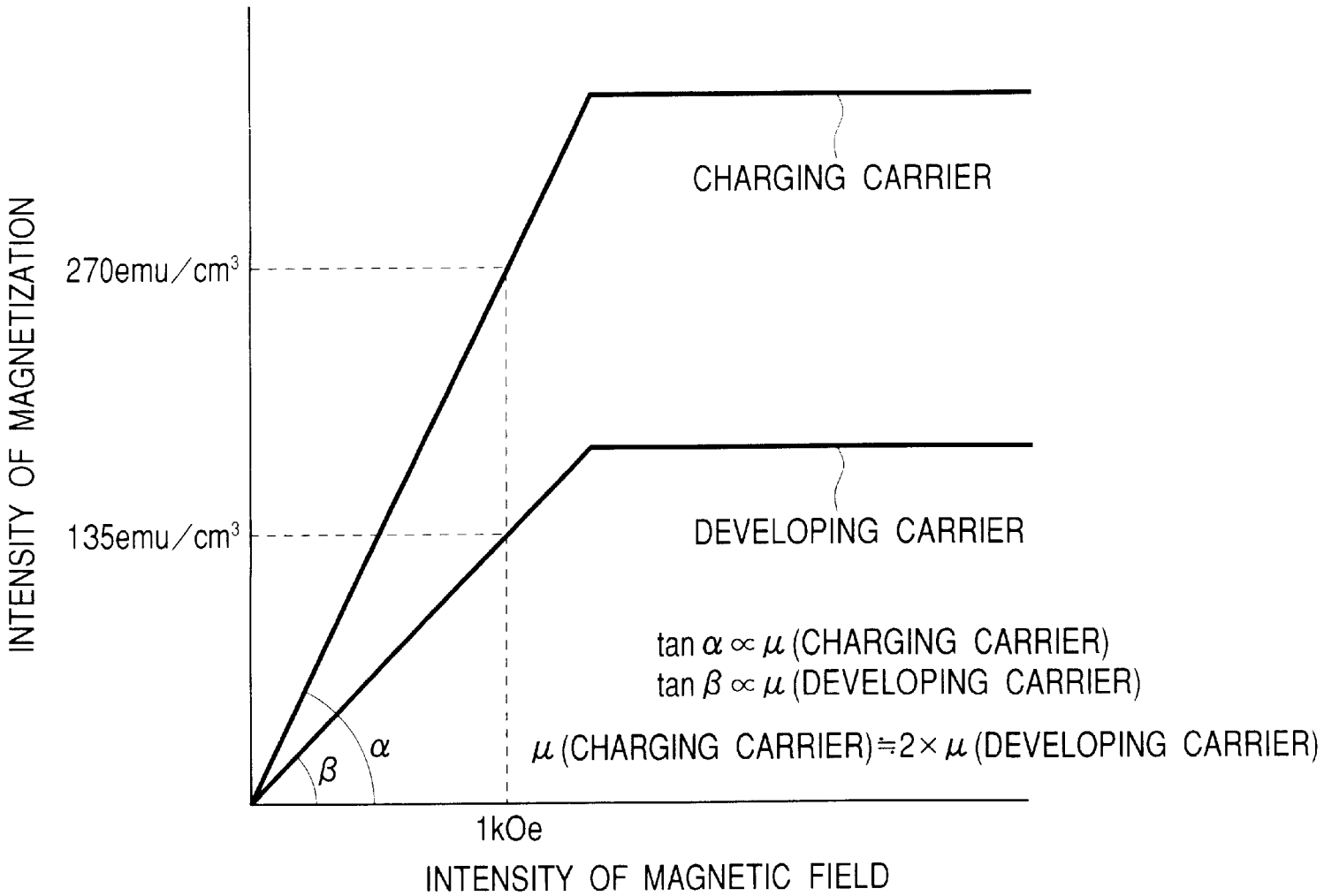
FIG. 5 is a diagram showing an example of the difference between the permeabilities of a charging carrier and a developing carrier.

Each of the charging carrier 23 and the developing carrier 41 used in this embodiment is a soft magnetic material and the intensity of magnetization of it increases linearly with the increase in the intensity of the magnetic field in a magnetic field of up to about 1 kilo-oersted. Therefore, the permeability is proportional to the inclination tan $\alpha$ or tan $\beta$ shown in FIG. 5. In this embodiment, charging carrier 23 used in this embodiment has an intensity of magnetization ($\sigma$1000) approximately twice that of the development carrier 41 in a magnetic field at 1 kilo-oersted and, therefore, has a permeability twice that of the development carrier 41.

If, as in this embodiment, magnetic carriers differing in permeability are used as the charging carrier 23 and the developing carrier 41, and if the charging carrier 23 mixes into the developing device 4, the apparent permeability detected with the inductance head 30 varies even when the density of toner in the developing device is constant, as described below in detail.

An inductance detection type of toner density controller will next be described.

As mentioned above, the two-component developer 43 has the developing carrier 41 and the nonmagnetic toner 42 as its main components. If the toner density (the proportion of the weight of toner particles to the total weight of carrier particles and toner particles) in the developer 43 is changed by, for example, consumption of the toner 42 in development, the apparent permeability changes according to the mixture ratio of the development carrier 41 and the nonmagnetic toner 42 in a certain volume.

Figure 6:
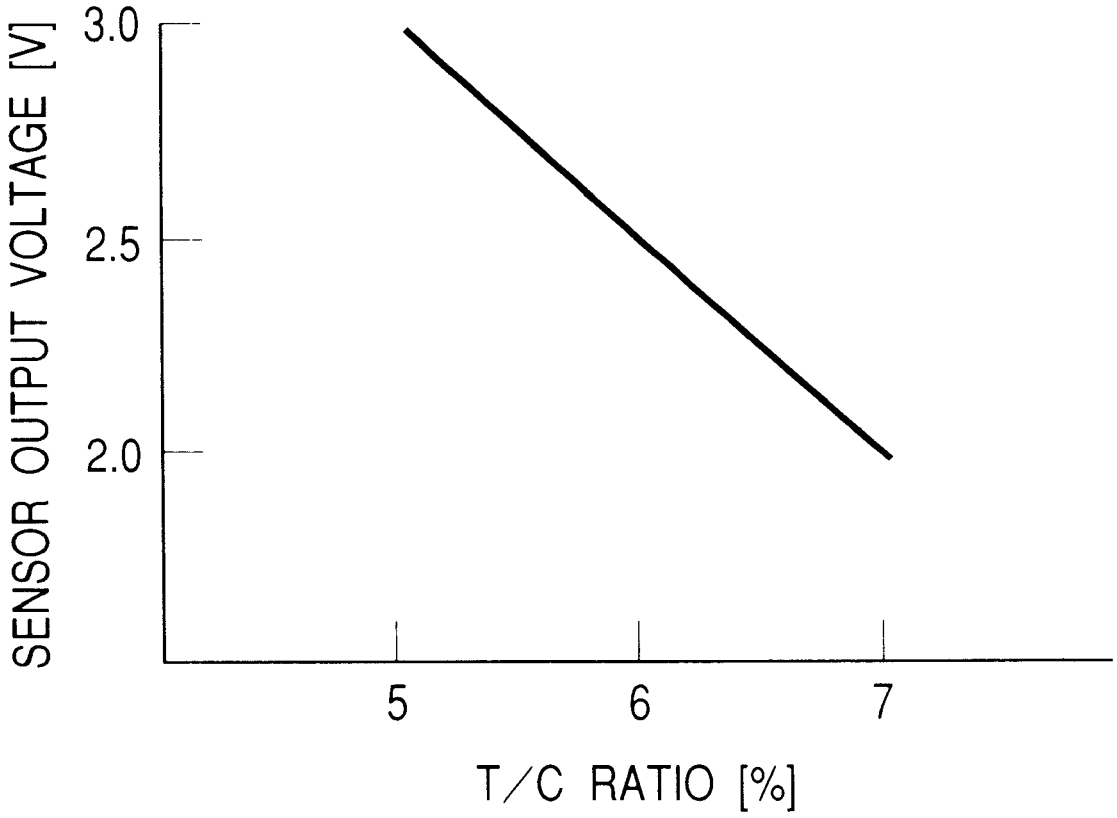
FIG. 6 is a diagram showing an example of a change in a detection signal from an inductance head with respect to the toner density.

This apparent permeability is detected and converted into an electrical signal by the inductance head 30. This electrical signal changes generally linearly according to the toner density, as shown in FIG. 6. That is, the detection signal (output electrical signal) from the inductance head 30 corresponds to the actual toner density in the two-component developer 43 in the developing container 44. The abscissa of FIG. 6 represents a T/C ratio (the ratio of the amount of the toner to the amount of the carrier), and the ordinate represents the electrical signal obtained by converting the output signal from the inductance head 30.

Processing of the detection signal from the inductance head 30 will be described with reference to FIG. 7.

The detection voltage signal from the inductance head 30 is input to one of two input terminals of a comparator 31. A reference electrical signal provided as a target value corresponding to the apparent permeability of the developer 43 when the developer 43 has a prescribed toner density (an initial set value of the toner density in the developer 43) is input to the other terminal of the comparator 31. Accordingly, the comparator 31 compares the prescribed toner density and the actual toner density in the developing container 44, and supplies an output signal from the comparator 31 as a result of the comparison between the two signals to a control means 67 constituted of a CPU.

The control means 67 performs control on the basis of the detection signal from the comparator 31 such as to adjust the next toner supply time. For example, when the detection output from the inductance head 30 is smaller than the target value (the actual toner density in the developer 43 is lower than the prescribed value), that is, if the supply of toner is insufficient, the control means 67 operates the transport screw 62 of the toner supply tank 60 so as to supply the amount of toner corresponding to the deficiency of toner. That is, the control means 67 computes the screw rotation time necessary for supplying the amount of toner corresponding to the deficiency to the developing container 44 on the basis of the output signal from the comparator 31 by using a operational equation or a table stored in a random access memory (RAM) 68 provided as a storage means. The control means 67 controls a motor drive circuit 69 so that the motor drive circuit 69 rotates a motor 70 for the computed time, thereby supplying the replenishment toner 63 of the amount of toner corresponding to the deficiency to the developing container 44.

When the detection output from the inductance head 30 is larger than the target value (the actual toner density in the developer 43 is higher than the prescribed value), that is, when an oversupply of toner occurs, the control means 67 computes the excessive amount of toner in the developer 43 in the developing container 44 on the basis of the output signal from the comparator 31. When the image forming apparatus thereafter forms images, the control means 67 performs such control that toner is supplied so that the excessive amount of toner is eliminated, or, while images are being formed, the supply of toner is stopped until the excessive amount of toner is used up, that is, images are formed with no toner supply to consume the excessive amount of toner, and the toner supply operation described above is started after the excessive amount of toner has been consumed.

In this embodiment, a prescribed toner density of 6% is set as an optimum toner density in the developer 43. When the toner density is higher than this value, there is a possibility of occurrence of toner fogging, scattering or the like. When the toner density is lower than this value, there is a possibility of the image density being excessively light. In an initial state, as described below in detail, the reference voltage signal for comparison with the detection voltage signal from the inductance head 30 is set to 2.5 V corresponding to the optimum toner density, which is 6%.

The above-described toner supply operation will be further described with reference to the flowchart of FIG. 8.

When the image forming apparatus starts operating (step 1), detection of the toner density is started (step 2). A detection voltage signal "a" from the inductance head 30 is input to the comparator 31 (step 3). The comparator 31 compares the detection voltage signal "a" with a reference voltage signal "b" from a reference voltage signal source 32 (step 4). Next, a signal representing the difference (a−b) between the detection voltage signal "a" and the reference voltage signal "b" is supplied to the control means 67 (step 5). The control means 67 makes a determination as to whether (a−b)>0 (step 6). If the toner density is lower than the reference value (YES), the amount of toner to be supplied, i.e., the rotation time of the transport screw 62 is determined (step 7). Subsequently, the image forming operation is started (step 8) and supply of toner is performed for the toner supply time determined in step 7 between forming images and time periods for forming images (between images) (step 9). Then the process returns to step 2 of starting detecting the toner density.

If it is determined in step 6 that the toner density is higher than the reference value (NO), the image forming operation is then started (step 10) and the process returns, without supplying toner, to step 2 of starting detecting the toner density.

Figure 8:
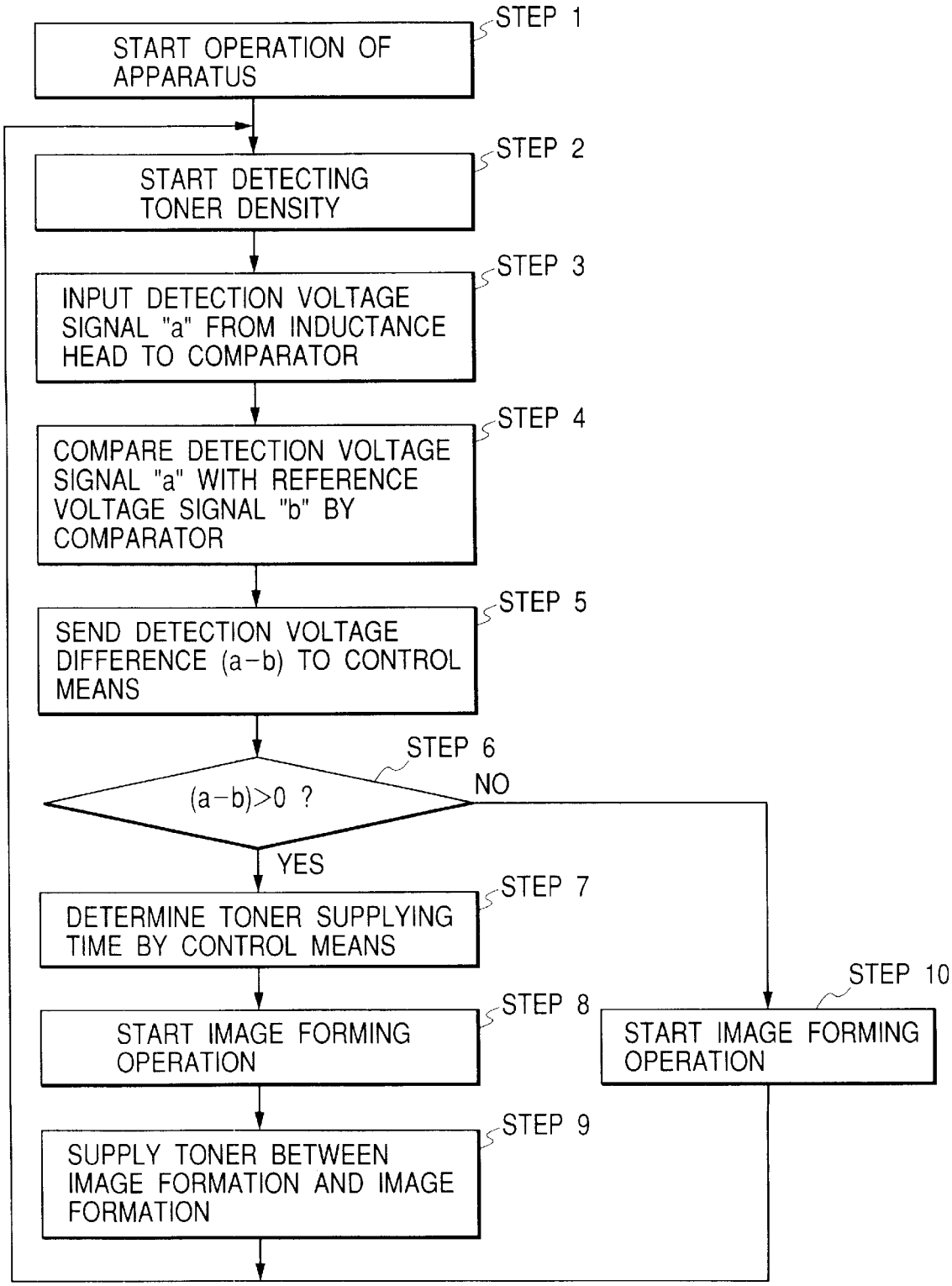
FIG. 8 is a flowchart for explaining an example of toner supply operation in accordance with the present invention.

In the process shown in the flowchart of FIG. 8, detection of the toner density is started just before the image forming operation is started (restarted). As regards the timing of the toner density detection, however, may be started at a time during the image forming operation as well as at a time just before the image forming operation is restarted. For example, the toner density detection is performed just before the start of the image forming operation for forming an image on a first sheet after a start of the apparatus 100, and is performed during the image forming operation for forming images on sheets subsequently fed.

Thus, the inductance detection type of toner density controller of this embodiment compares the detection voltage signal "a" and the reference voltage signal "b" and adjusts the amount of toner supplied so that the detection voltage signal "a" from the inductance head 30 becomes equal to a reference voltage signal value "b" of a detection voltage signal set to 2.5 V in the optimum toner density (6% in this embodiment).

That is, in this embodiment, toner is supplied when the detection voltage signal value "a" from the inductance head 30 is larger than the reference voltage signal value "b" (for example, 3.0 V), and the supply of toner is stopped when the detection voltage signal value "a" from the inductance head 30 is smaller (for example, 2.0 V). Needless to say, the present invention is not limited to this signal processing, and the circuit arrangement may alternatively be such that a reference voltage signal value different from 2.5 V is set, or such that the value of the detection voltage signal from the inductance head 30 is smaller than the reference signal value when the toner density is lower than the optimum value, and the value of the detection voltage signal from the inductance head 30 is larger than the reference voltage signal value when the toner density is higher than the optimum value because of a change of the circuit structure.

The image forming apparatus 100 using the magnetic-brush-type charging device 2 may also have the above-mentioned problem of the charging carrier 23 forming the magnetic-brush-type charging member 26 being attached to the surface of the photosensitive drum 1 to flow out. In a developing device 4 using a conventional inductance detection type of a toner density controller, if the charging carrier 23 attached to the photosensitive member and flowing out is collected in the developing device 4, it. is gradually accumulated in the developing device 4 as the image forming operation is repeated to from images on an increasing number of sheets, although the amount of the charging carrier attached to the photosensitive member is not so large as to immediately influence the quality of formed images. If the developing carrier 41 and the charging carrier 23 differ in permeability, the apparent permeability of the developer 43 as a whole may change to cause an error in toner density control performed by the toner density controller even when the toner density in the developing device is constant.

Figure 9:
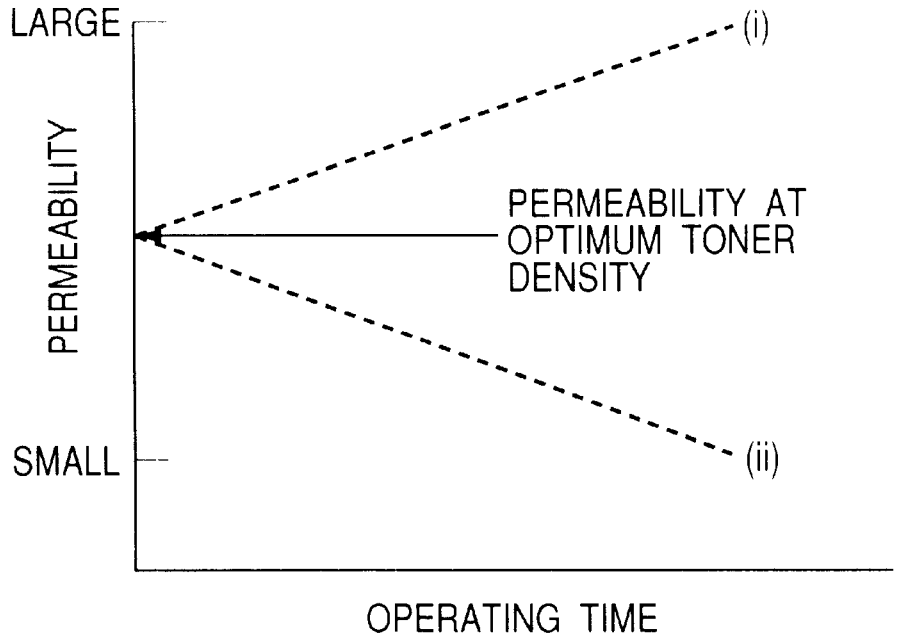
FIG. 9 is a diagram for explaining the relationship between the operating time of the image forming apparatus and the apparent permeability of a developer.

This problem of the conventional art will be further described with reference to FIGS. 9 through 11 with respect to a case where the optimum toner density in the developer 43 is set to 6%, and an initial value of 2.5 V is set as the reference voltage signal of the detection voltage signal from the inductance head 30 which corresponds to the apparent permeability of the developer 43 at this toner density.

As the image forming operation is repeated to gradually accumulate the charging carrier 23 in the developing device 4, the apparent permeability of the developer 43 in the developing device 4 changes. That is, if the permeability of the charging carrier 23 is larger than that of the developing carrier 41, the apparent permeability of the developer 43 increases gradually, as indicated by a dotted line (i) in FIG. 9. Conversely, if the permeability of the charging carrier 23 is smaller than that of the developing carrier 41, the apparent permeability of the developer 43 decreases gradually, as indicated by a dotted line (ii) in FIG. 9. The abscissa of FIG. 9 represents the operating time of the developing device.

Figure 10:
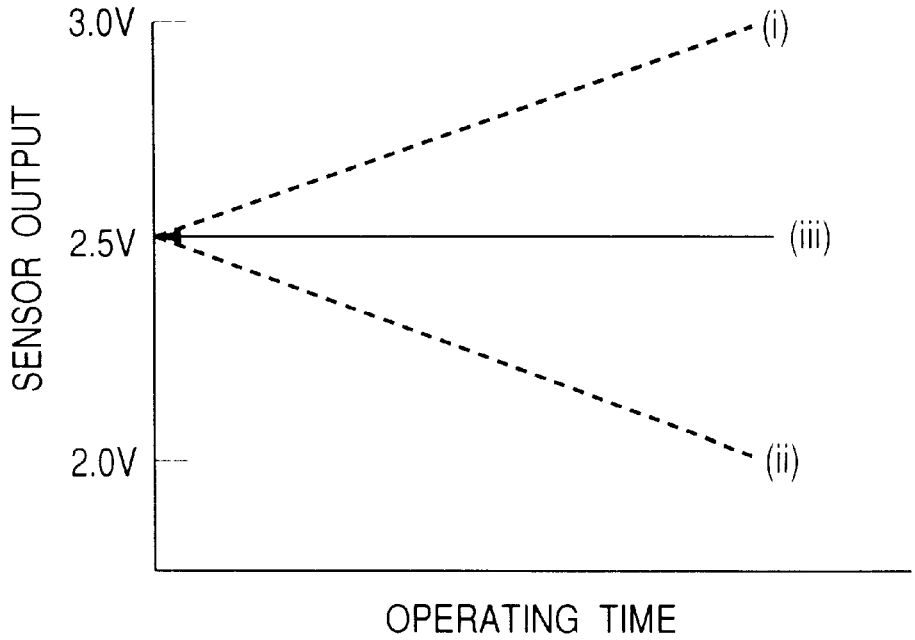
FIG. 10 is a diagram for explaining the relationship between the operating time of the image forming apparatus and the detection voltage signal from the inductance head.
Figure 11:
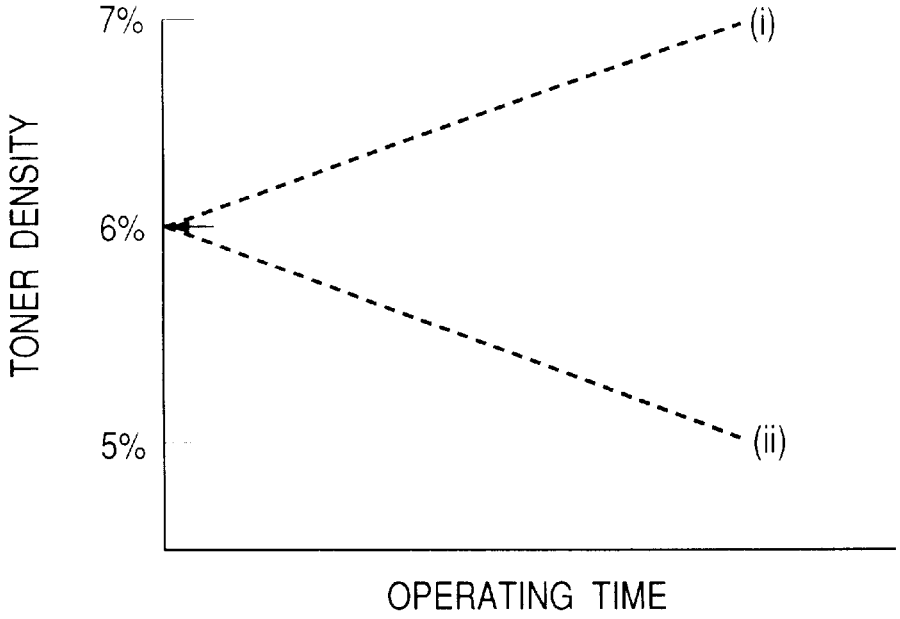
FIG. 11 is a diagram for explaining the relationship between the operating time of the image forming apparatus and the toner density.

Correspondingly, in the case where the permeability of the charging carrier 23 is larger than that of the developing carrier 41, the detection voltage signal from the inductance head 30 increases gradually, as indicated by a dotted line (i) in FIG. 10. In the case where the permeability of the charging carrier 23 is smaller than that of the developing carrier 41, the detection voltage signal decreases gradually, as indicated by a dotted line (ii) in FIG. 10.

Actually, however, the toner density controller supplies toner so that the toner density is constantly maintained at 6% set initially or within a suitable range of about 6% corresponding to the optimum value, that is, the value of the detection voltage from the inductance head 30 is always equal to the reference value initially set to 2.5 V, as indicated by a solid line (iii) in FIG. 10. In the case where the permeability of the charging carrier 23 is larger than that of the developing carrier 41, the toner density controller supplies toner to reduce the apparent permeability of developer 43, thereby causing the toner density to increase gradually, as indicated by a broken line (i) in FIG. 11. In the case where the permeability of the charging carrier 23 is smaller than that of the developing carrier 41, the toner density controller stops supplying toner to increase the apparent permeability of the developer 43, thereby causing the toner density to decrease gradually, as indicated by a broken line (ii) in FIG. 11.

This problem will be further explained hereinbelow with respect to a more concrete example related to the image forming apparatus 100 of this embodiment in a case where the permeability of the charging carrier 23 is larger than (about twice) that of the developing carrier 41. However, the solution in accordance with the present invention is not limited to the case where the permeability of the charging carrier 23 is larger than that of the developing carrier 41. As can be understood from the description made with reference to FIGS. 9 through 11, the principle of the present invention can be applied to either of the case where the permeability of the charging carrier 23 is larger and the case where the permeability of the developing carrier 41 is larger if the charging carrier 23 and the developing carrier 41 differ in permeability from each other.

According to studies made by the inventor of the present invention as described above, the amount of mixing of the charging carrier 23 in the developing device 4 varies depending upon an environment (atmosphere) in the image forming apparatus and different characteristics of each development device 4 such as color variations of each developer.

Figure 12:
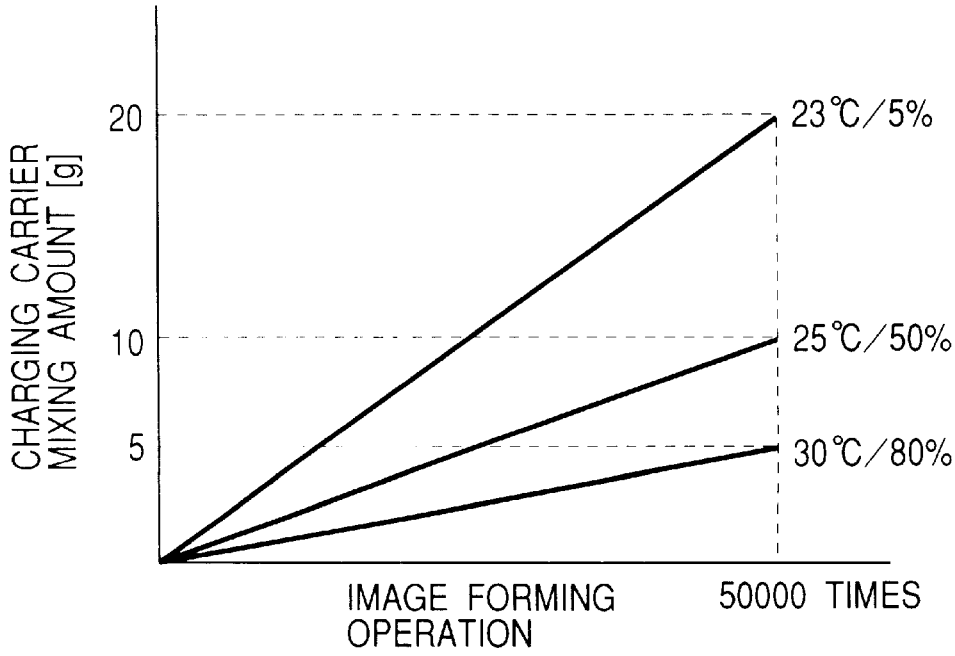
FIG. 12 is a diagram showing variation in the mixing amount of the charging carrier with respect to an environment (temperature, humidity)

More specifically, if the humidity is lower, more strictly, if the absolute amount of water in the air is smaller, the amount of mixing of the charging carrier 23 in the developing device 4 increases, as shown in FIG. 12. That is, in a low-humidity environment, the resistance of each of the charging carrier 23 and the photosensitive drum 1 is increased, as mentioned above. The efficiency of charge injection into the photosensitive drum 1 through the charging carrier 23 is thereby reduced, so that the charging potential on the surface of the photosensitive drum 1 is lower than the bias applied to the charging device 2. In such a situation, a potential difference is caused between extreme ends of the mass of the charging carrier 23 and the surface of the photosensitive drum 1. As a result, the charging carrier 23 becomes liable to be attached to the photosensitive drum 1 to increase the amount of the charging carrier 23 attached to the photosensitive drum 1 and the amount of the charging carrier 23 mixing in the developer 43 in the developing device 4.

It was found that in the image forming apparatus 100 of this embodiment the amount of mixing of the charging carrier 23 in the cyan developing device 4C in an environment at a temperature of 25° C. and a humidity of 50% was about 10 g at the end of the process of repeating the image forming operation for 50,000 times. An experiment was then performed as described below. First, the toner density was adjusted so that the detection signal from the inductance head 30 was 2.5 V, thereby setting the optimum toner density (6%) in the developer 43 in the cyan developing device 4C. Thereafter, forced mixing of 10 g of the charging carrier 23 in the developer 43 was effected. The apparent permeability of the developer 43 was thereby increased and the detection voltage signal from the inductance head 30 was then increased by 0.5 V from 2.5 V, i.e., the initial reference voltage signal value, to 3.0 V while control for maintaining the initial optimum toner density was performed. In such a situation, if toner density control is actually performed in the conventional manner, toner is supplied so that the detection voltage signal from inductance head 30 becomes equal to 2.5 V, resulting in occurrence of an excess toner supply. For example, if the inductance head 30 used in the image forming apparatus 100 of this embodiment, which has a sensitivity of 0.5 V/% (toner density) (FIG. 6) (0.5 Volt per one percentage of T/C ratio), is used, and if the image forming operation is repeated for 50,000 times, the final toner density obtained as a result of the above-described control is 7%, differing 1% from the optimum toner density set to 6%.

It was also found that in the image forming apparatus 100 of this embodiment the amount of mixing of the charging carrier 23 in the cyan developing device 4C in an environment at a temperature of 23° C. and a humidity of 5% was about 20 g at the end of the process of repeating the image forming operation for 50,000 times. An experiment was then performed as described below. First, the toner density was adjusted so that the detection voltage signal from the inductance head 30 was 2.5 V, thereby setting the optimum toner density (6%) in the developer 43 in the cyan developing device 4C. Thereafter, forced mixing of 20 g of the charging carrier 23 in the developer 43 was effected. The apparent permeability of the developer 43 was thereby increased and the detection voltage signal from the inductance head 30 was then increased by 1 V from 2.5 V, i.e., the initial reference value, to 3.5 V while control for maintaining the initial optimum toner density was performed. In such a situation, if toner density control is actually performed in the conventional manner, toner is supplied so that the detection voltage signal from the inductance head 30 becomes equal to 2.5 V, resulting in occurrence of an excess toner supply. For example, if, as in the above-described case, the inductance head 30 having a sensitivity of 0.5 V/% (toner density) (FIG. 6) is used, and if the image forming operation is repeated for 50,000 times, the final toner density obtained as a result of the above-described control is 8%, differing 2% from the optimum toner density set to 6%.

Figure 13:
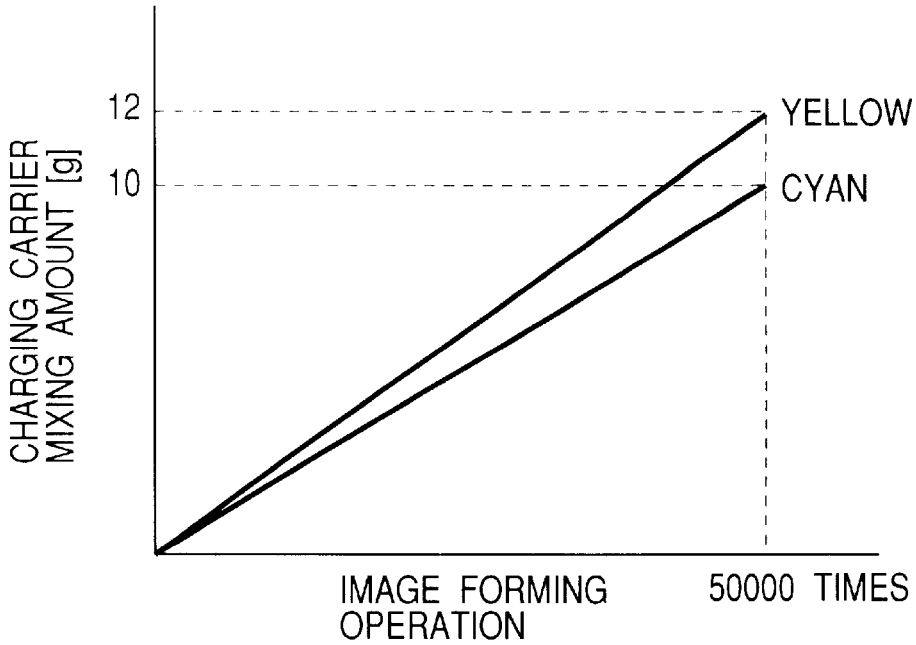
FIG. 13 is a diagram showing variation in the mixing amount of the charging carrier with respect to the developing devices (different colors of developers)

Further, according to studies made by the inventor of the present invention, even in the same environment, the mixing amount of the charging carrier 23 varies depending upon the characteristics of each developing device, e.g., the colors of toners used in the developing device, as shown in FIG. 13. FIG. 13 shows a comparison between the yellow and cyan developing devices 4Y and 4C in an environment at a temperature of 25° C. and a humidity of 50% by way of example. According to the studies made by the inventor of the present invention, the same can also be said with respect to developing devices using other colors different from each other.

That is, as described above, if toner remaining on each photosensitive drum 1 without being transferred, i.e., transfer residue toner, mixeses into the charging device 2, the resistance of the magnetic-brush-type charging member 26 is increased to reduce the efficiency of charge injection into the photosensitive drum 1, thereby making the charging carrier 23 liable to be attached to the photosensitive drum 1.

On the other hand, the efficiency of transfer of a toner image formed on the photosensitive drum 1 to the recording member varies according to the toner colors, so that the amount of transfer residue toner and even the amount of transfer residue toner mixing into the charging device 2 vary. For this reason, each developing device for forming toner images by using developers of different colors has different mixing amount of the charging carrier 23.

Therefore each developing device has a different amount of charging carrier accumulated as the image forming operations are repeated. Consequently, varying degrees of error in toner density control occur with respect to each developing device.

By considering this problem, the image forming apparatus 100 of this embodiment is arranged to perform a control process in which erroneous results of detection and control of the toner density by the inductance detection type of toner density controllers due to mixing of the charging carrier 23 in the developer 43 are corrected according to the corresponding environment and/or the characteristics of the corresponding developing device, e.g., the color of the developer used in the developing device to ensure that the toner density can be constantly maintained at a predetermined value or within a suitable range even if the image forming operation is repeated for a large number of times.

More specifically, the image forming apparatus 100 of this embodiment has a reference signal correcting means 35 for correcting the reference voltage signal value, which corresponds to an optimum toner density previously set, and with which the detection voltage signal from the inductance head 30 is compared, by predetermined timing based on the operating time of the developing device or the number of times the developing device operates.

Figure 7:
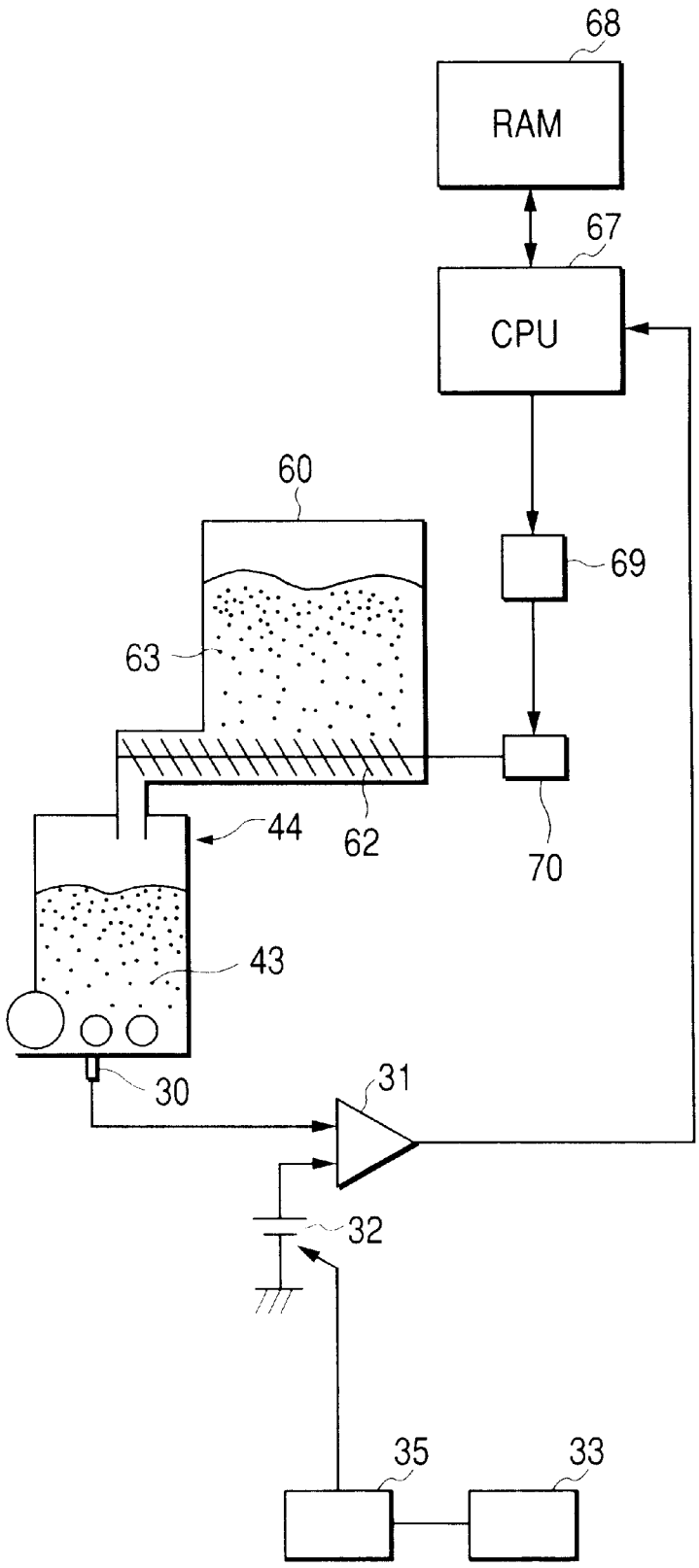
FIG. 7 is a diagram for explaining toner supply control by an inductance detection type of toner density controller in accordance with the present invention.

In this embodiment, as shown in FIG. 7, the reference signal value correcting means 35 is constituted as a central processing unit (CPU) 35 having an instruction set in advance to change the set value of the reference voltage signal value for comparison with the detection voltage signal from the corresponding inductance head 30 when the image forming operation is performed for a certain time period or a certain number of time.

Different amounts of correction at the time of changing the set reference value are set with respect to different environments and each of the developing devices 4Y to 4K. At a predetermined timing, the reference signal value correcting means 35 newly sets the reference voltage signal value to be output from the reference voltage signal source 32.

The reference signal value correcting means 35 corrects the reference voltage signal values relating to the detection voltage signals from the inductance heads 30 by different correcting amounts with respect to each of the developing devices 4Y to 4K according to environments in which each of the developing devices 4Y to 4K are placed at the predetermined timings based on, for example, the operating time or the number of times each of the developing devices 4Y to 4K are operated, and by using temperature/humidity information from a temperature/humidity sensor 33 provided as an atmosphere sensor in the image forming apparatus 100 and timing information obtained in a way described below in detail.

Environment sensors 33, such as temperature/humidity sensors, may be respectively provided at each of the developing devices 4Y to 4K.

A concrete example of the above-described correction will be described with respect to a case where the initial value 2.5 V of the reference voltage signal for comparison with the detection voltage signal from the inductance head 30 for the cyan developing device 4C is corrected after repeating the image forming operation for 25,000 times in an environment at a temperature of 25° C. and a humidity of 50%. In the image forming apparatus 100 of this embodiment, if the amount of mixing of the charging carrier 23 in the cyan developing device 4C is proportional to the number of times the image forming operation is repeated, the amount of mixing of the charging carrier 23 in the cyan developing device 4C in this environment after repeating the image forming operation for 50,000 times is 10 g (10 g/50,000 times) (see FIG. 3). Accordingly, the mixing amount after repeating the image forming operation for 25,000 times is 5 g (5 g/25,000 times). Here, as described above, in the image forming apparatus 100 of this embodiment, the value of the detection voltage from the inductance head 30 changes by 0.5 V as a result of mixing of 10 g of the charging carrier 23. Accordingly, the value of the detection voltage from the inductance head 30 changes by 0.25 V in the case of mixing of about 5 g of charging carrier 23.

In the reference signal value correcting means 35, therefore, an instruction is set in advance to change the reference voltage value "b" of the detection voltage signal in the step 4 shown in the flowchart of FIG. 8, i.e., the reference voltage signal value for comparison with the detection voltage signal from the inductance head 30 for the cyan developing device 4C at 25° C. and a humidity of 50% in this case, from 2.5 V, i.e., the initial value, to 2.75 V when the number of times the image forming operation is repeated becomes equal to 25,000. At the corresponding timing, the control means 35 changes the reference value "b" output from the reference voltage signal source 32 to 2.75 V.

Figure 14:
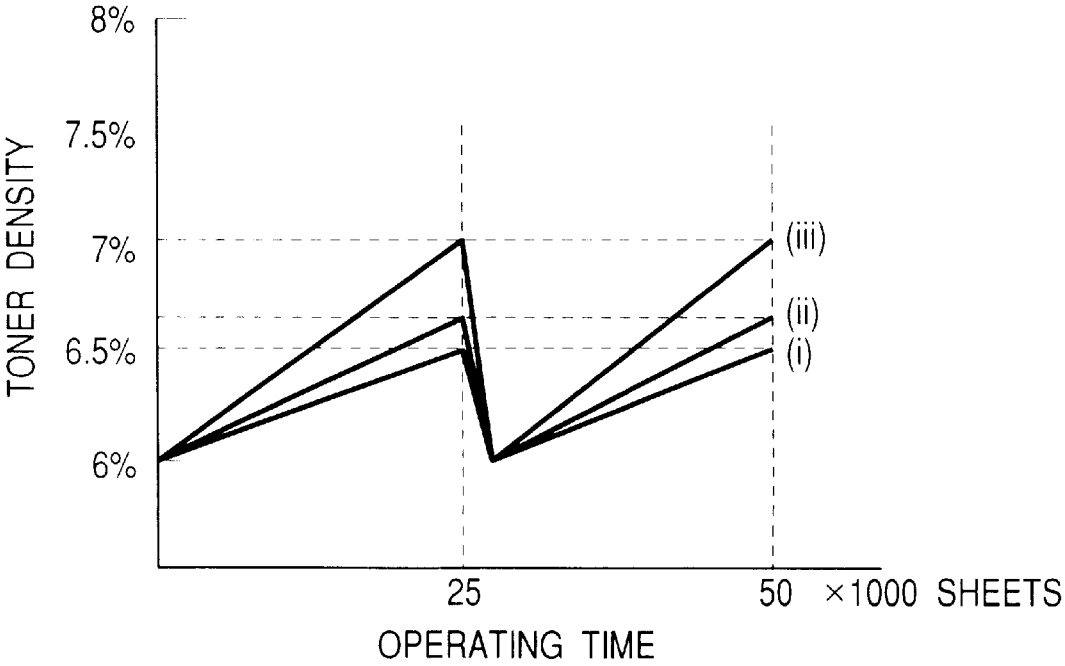
FIG. 14 is a diagram showing an example of the relationship between the operating time of the image forming apparatus and the toner density under toner density control in accordance with the present invention.

The supply of toner is thereby stopped until the detection voltage signal from the inductance head 30 becomes equal to 2.75 V after the correction of the reference voltage signal value "b", as indicated by line (i) in FIG. 14, thereby eliminating the toner density error existing before and resetting the toner density to the initial toner density, which is 6%. As a result, the: toner density at the time when the number of times the image forming operation is repeated becomes equal to 50,000 is about 6.5%. Thus, the toner density control error can be reduced as compared with that in the case where the reference signal for comparison with the detection signal from the inductance head 30 is not corrected.

Another example of the above-described correction will be described with respect to a case where the initial value 2.5 V of the reference voltage signal for comparison with the detection voltage signal from the inductance head 30 for the yellow developing device 4Y is corrected after repeating the image forming operation for 25,000 times in the environment at a temperature of 25° C. and a humidity of 50%. In the image forming apparatus 100 of this embodiment, if the amount of mixing of the charging carrier 23 in the yellow developing device 4Y is proportional to the number of times the image forming operation is repeated, the amount of mixing of the charging carrier 23 in the yellow developing device 4Y in this environment after repeating the image forming operation for 50,000 times is 12 g (12 g/50,000 times) (see FIG. 13). Accordingly, the mixing amount of the charging carrier 23 after repeating the image forming operation for 25,000 times is 6 g (6 g/25,000 times). In this embodiment, the value of the detection voltage from the inductance head 30 at that time changes by 0.3 V.

In the case of the yellow developing device 4Y, therefore, an instruction is set in advance in the reference signal value correcting means 35 to change the reference voltage value "b" of the detection voltage signal in the step 4 shown in the flowchart of FIG. 8, i.e., the reference voltage signal value for comparison with the detection voltage signal from the inductance head 30 for the yellow developing device 4Y at a temperature of 25° C. and a humidity of 50% in this case, from 2.5 V, i.e., the initial value, to 2.80 V when the number of times the image forming operation is repeated becomes equal to 25,000. The reference signal value correcting means 35 corrects the reference value of the detection signal from the inductance head 30 at the predetermined timing to stop the supply of toner until the detection signal becomes equal to 2.80 V after the correction, thereby also reducing the toner density control error at the time when the number of times the image forming operation is repeated becomes equal to 50,000 with respect to the yellow developing device 4Y, as indicated by line (ii) in FIG. 14.

Similarly, with respect to each of the magenta and black developing devices 4M and 4K, the mixing amount of the charging carrier 23 mixing into the magenta developing device 4M or the black developing device 4K in a predetermined environment (at a temperature of 25° C. and a humidity of 50% in this case) at the end of a certain time period (after the number of times the image forming operation has been repeated for a certain number of times) is obtained, an amount by which the reference value of the detection signal from the inductance head 30 is corrected is determined according to the amount of charging carrier 23 obtained, and an instruction is set in the reference signal value correcting means 35 to correct the reference value relating to the detection signal from the inductance head 30 at a predetermined timing, thereby correctly maintaining the toner density in the magenta or black developer.

A description will next be made of a further example of the above-described correction in another environment at a temperature of 23° C. and a humidity of 5%. In this environment, the mixing amount of the charging carrier 23 mixing into the cyan developing device 4C is 20 g at the time when the image forming operation is repeated becomes equal to 50,000 (20 g/50,000 times) (see FIG. 12). Accordingly, the mixing amount is 10 g at the time when the number of times the image forming operation is repeated becomes equal to 25,000 (10 g/25,000 times). As described above, the detection voltage signal from the inductance head 30 changes by 0.5 V as a result of mixing of 10 g of the charging carrier 23. With respect to the cyan developing device 4C in this environment, therefore, an instruction is set in advance in the reference signal value correcting means 35 to change the set reference value of the detection signal from the inductance head 30 to from 2.5 V, i.e., the initial value, to 3.0 V when the number of times the image forming operation is repeated becomes equal to 25,000. The supply of toner is thereby stopped until the detection voltage signal reaches 3.0 V after the correction of the reference value of the detection voltage signal from the inductance head 30, as indicated by line (iii) in FIG. 14, thereby :eliminating the toner density error existing before and resetting the toner density to the initial toner density, which is 6%. As a result, the toner density at the time when the number of times the image forming operation is repeated becomes equal to 50,000 is about 7%. Thus, the toner density control error can be reduced as compared with that in the case where the reference signal voltage value of the detection signal from the inductance head 30 is not corrected according to the environment.

Similarly, with respect to each of the developing devices 4Y, 4M, and 4K other than the cyan developing device 4C in the environment at a temperature of 23° C. and a humidity of 5%, an instruction for the desired correction of the reference value of the signal from the inductance head 30 is set in the reference signal value correcting means 35, thereby reducing the toner density control error in each of the developing devices 4Y, 4M, or 4K in this environment. Further, with respect to each of the developing devices 4C, 4Y, 4M, and 4K in a further different environment, e.g., an environment at a temperature of 30° C. and a humidity of 80%, an instruction may be set as desired to correct the reference value of the signal from the inductance head 30. An instruction may also be set with respect to each of the developing devices 4C, 4Y, 4M, and 4K in other environments to correctly maintain the toner density in the developer in each developing device in each environment.

Generally no restrictions are imposed on the timing of changing the reference value of the detection signal from the inductance head 30. However, a certain kind of means for counting the number of times the image forming operation is repeated may be used. For example, the control means 67 may determine the number of times on the basis of information on the number of sheets on which images have been formed (the number of times) obtained in each of the developing devices 4Y to 4K or on the basis of a video count in an image information signal formed by using each developing device. Also, a certain kind of means for measuring the total time period through which the image forming operation is performed may be used. For example, the control means 67 may determine the total operating time on the basis of the operating times separately measured with respect to each of the developing devices 4Y to 4K.

According to the present invention, even if the image forming operation is repeated for a large number of times, the toner density in the developer 43 can be controlled so as to be always constant or within a suitable range, thereby ensuring that images can be formed with stability in image quality over a long time period.

(Embodiment 2)

Next, another embodiment of the present invention will be described. An image forming apparatus in this embodiment has basically the same construction as the image forming apparatus 100 of Embodiment 1. Components of this embodiment equivalent in function and construction to those in Embodiment 1 are indicated by the same reference characters, and will not be described in detail.

In Embodiment 1, the reference signal value correcting means 35 corrects the initial value of the reference voltage signal for comparison with the detection voltage signal from the inductance head 30 when the number of times the image forming operation is repeated is increased to 25,000. However, the timing of correction. in accordance with the present invention is not limited to this.

Figure 15A:
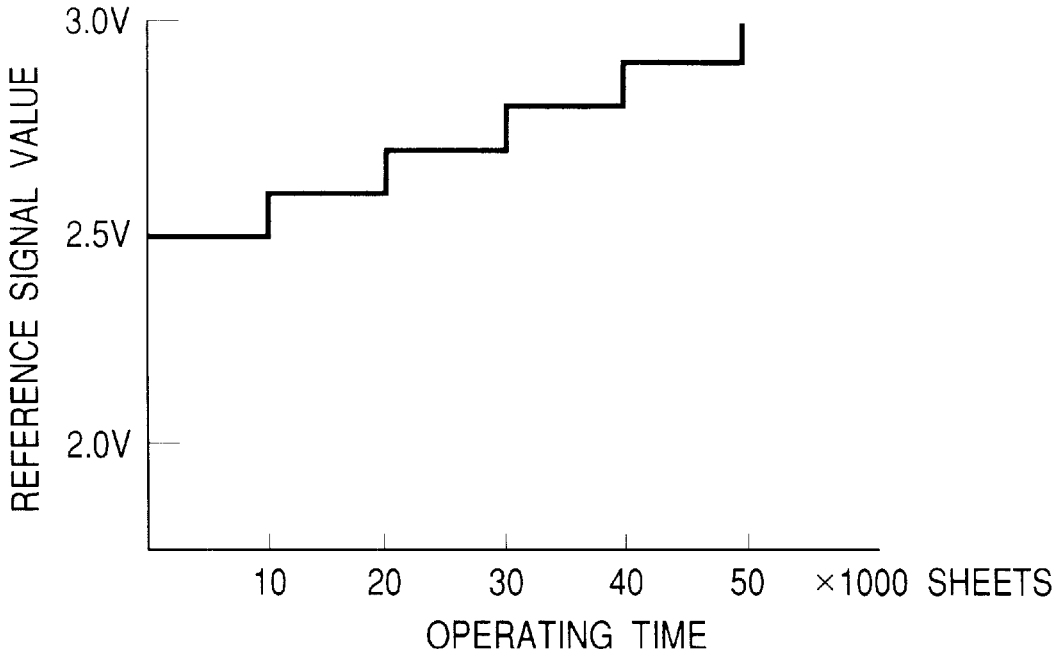
FIG. 15A is a diagram showing the relationship between the operating time of the image forming apparatus and the reference value for comparison with the detection signal from the inductance head under toner density control in accordance with the present invention.

In this embodiment, as shown in FIG. 15A, the reference signal value correcting means 35 is arranged to be newly set, with respect to each of different environments and each of the developing devices, the reference voltage signal value of the detection voltage signal from the inductance head 30 to a plurality of suitable levels. For example, when the number of times the image forming operation is repeated is increased to each of 10,000, 20,000, 30,000, 40,000, and 50,000, the reference value of the detection signal from the inductance head 30 is increased from one level to another.

Figure 15B:
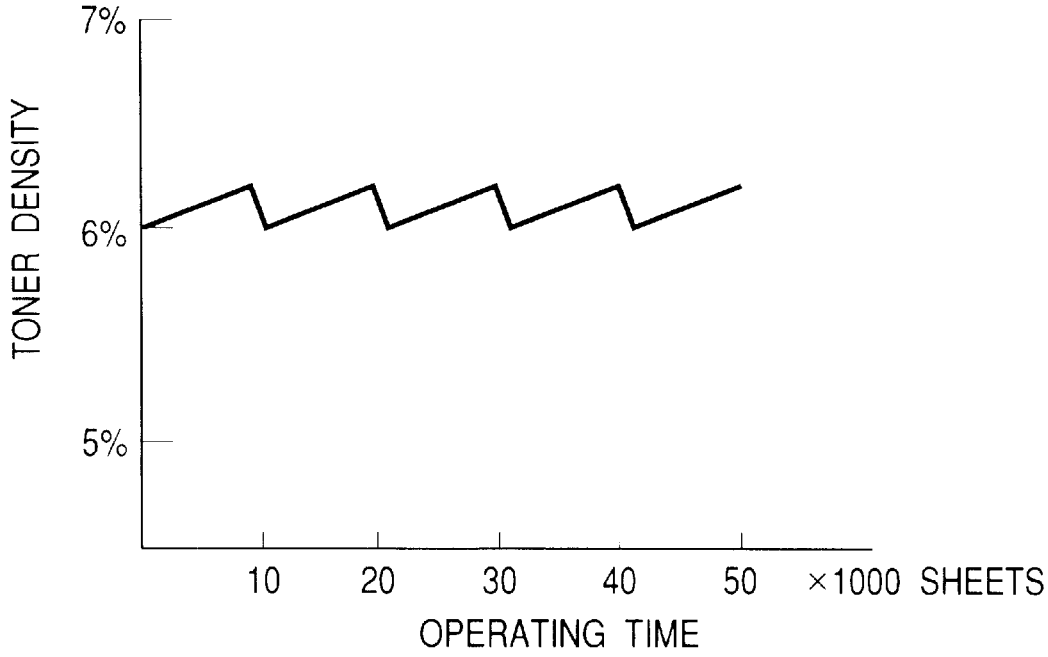
FIG. 15B is a diagram showing another example of the relationship between the operating time of the image forming apparatus and the toner density under toner density control in accordance with the present invention.

The arrangement according to this embodiment makes it possible to maintain the toner density more constantly at the desired level, as shown in FIG. 15B, thus achieving more accurate toner density control.

As in Embodiment 1, generally no restrictions are imposed on the timing of changing in a stepping manner the reference value of the detection signal from the inductance head 30. However, for example, the timing may be selected with respect to each of the developing devices 4Y to 4K as shown in FIG. 15A according to information on the number of sheets on which images have been formed (the number of times) or on the basis of a video count in an image information signal, or according to the image forming operating time.

Further, it is preferred that correction of the reference voltage signal value for comparison with the detection voltage signal from the inductance head 30 should be performed by the control means according to timing optimized with respect to each environment and/or the color of each developing device. For example, in a low-humidity environment, the mixing amount of charging carrier 23 into each of the developing devices 4Y to 4K is increased relative to that in a high-humidity environment, as described above, and the error in toner density control becomes greater as the image forming operation is repeatedly performed. In a low-humidity environment, therefore, it is preferable to gradually increase the reference value for comparison with the detection signal from the inductance head 30 at intervals smaller than those in a high-humidity environment. Also, as can be understood from FIG. 13, the mixing amount of charging carrier during image forming operation is larger in the yellow developing device 4Y than in the cyan developing device 4C, for example. Correspondingly, the error in toner density control becomes greater. The same problem should also be considered with respect to the other developing devices, and it is preferable to select, by considering the mixing amount of charging carrier 23 in each of the developing devices 4Y to 4K during image forming operation, intervals (timing) at which the point at which, the charging reference value of the detection signal from the inductance head 30 is corrected such that the toner density is always maintained at the desired level.

(Embodiment 3)

A still another embodiment of the present invention will be described. An image forming apparatus in this embodiment has basically the same construction as the image forming apparatuses 100 in Embodiments 1 and 2.

Figure 16A:
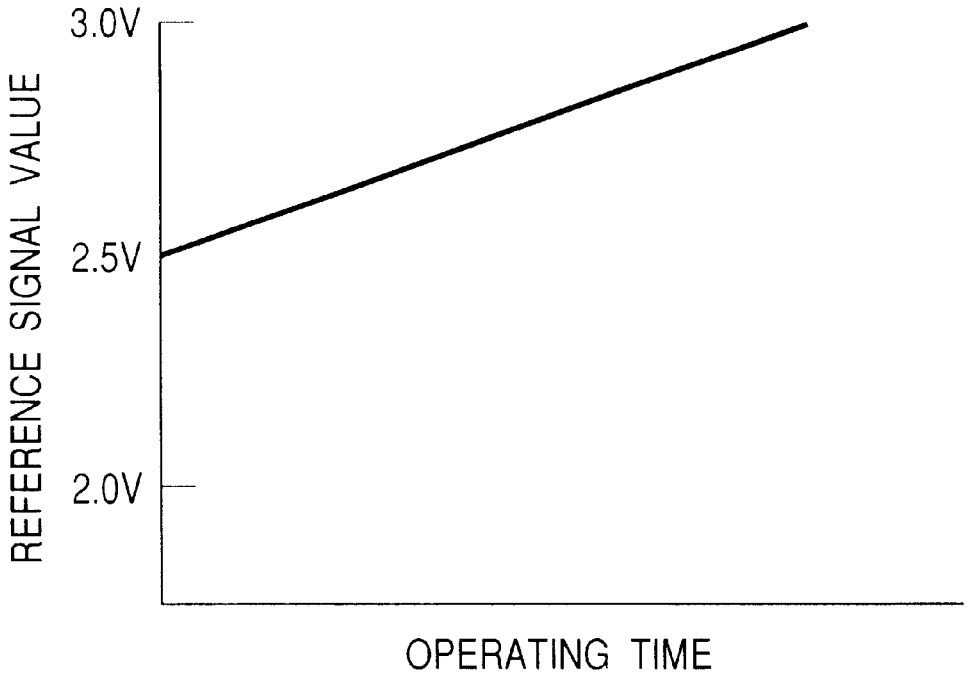
FIG. 16A is a diagram showing another example of the relationship between the operating time of the image forming apparatus and the reference value for comparison with the detection signal from the inductance head under toner density control in accordance with the present invention.

In this embodiment, as shown in FIG. 16A, the reference signal value correcting means 35 newly sets, suitably linearly, the reference voltage signal value for comparison with the detection voltage signal from the inductance head 30 with respect to each of different environments and each of the developing devices. The arrangement may be such that a rate at which the mixing amount of charging carrier 23 into each developing device 4 changes in each environment, which is substantially linear, is determined with respect to time periods during which the developing device operates to form images at comparatively short intervals, a comparatively small video count in an image information signal, or a comparatively small number of times the image forming operation is repeated, or such that a linear change in the mixing amount of charging carrier 23 is expressed by an equation using measured or computed values, and the reference voltage signal value is linearly corrected according to the linear change with respect to each environment and each developing device.

Figure 16B:
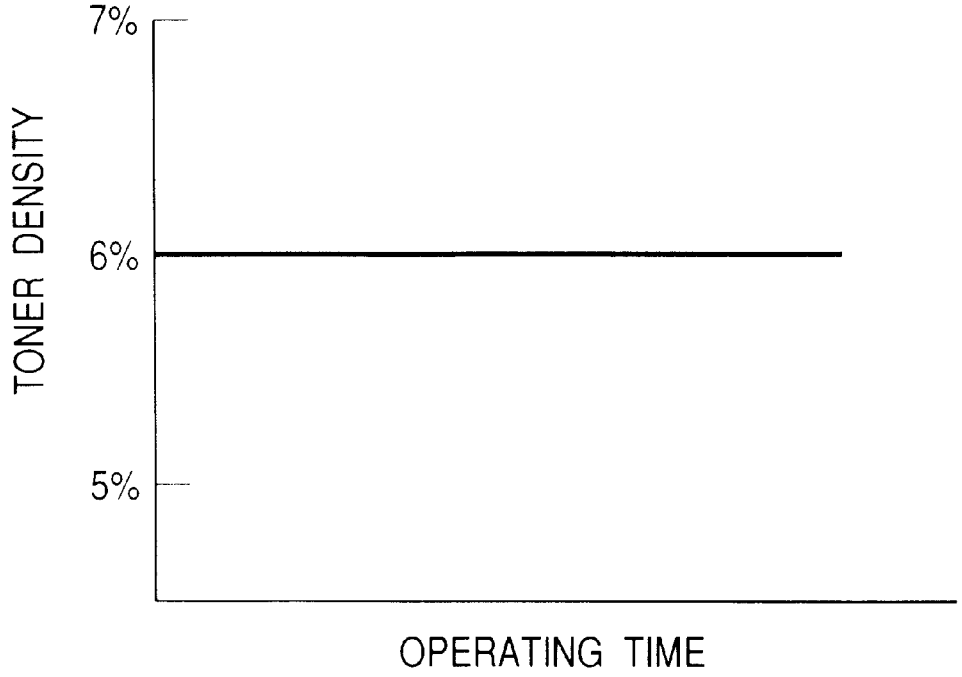
FIG. 16B is a diagram showing still another example of the relationship between the operating time of the image forming apparatus and the toner density under toner density control in accordance with the present invention.

In this manner, more accurate toner density control can be achieved, as shown in FIG. 16B.

(Embodiment 4)

A further embodiment of the present invention will be described. An image forming apparatus in this embodiment has basically the same construction as the image forming apparatuses 100 in Embodiments 1 to 3.

Figure 17:
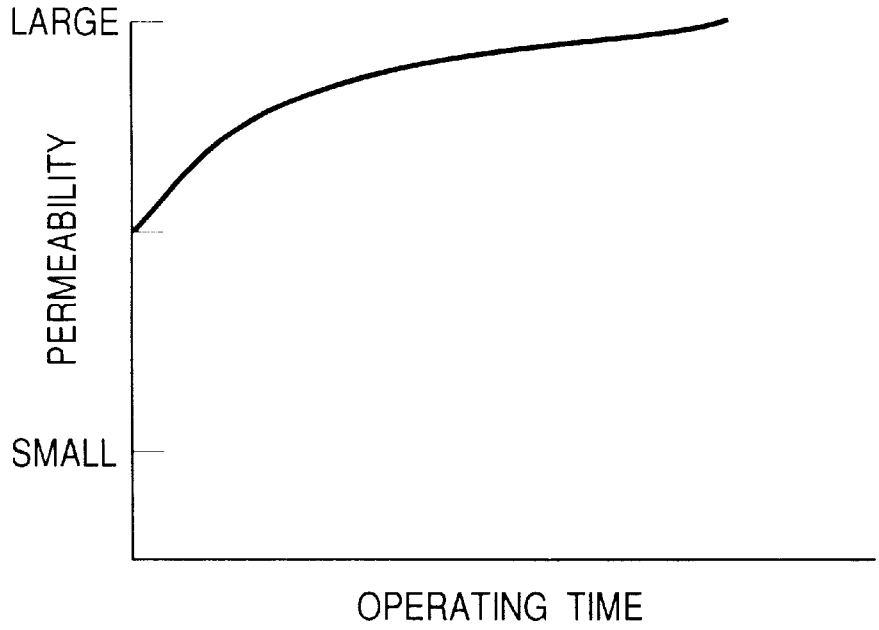
FIG. 17 is a diagram showing another example of the relationship between the operating time of the image forming apparatus and the apparent permeability of a developer.

Charging carrier 23 has a certain particle diameter distribution and, according to a study made by the inventor of the present invention, smaller particles of charging carrier 23 are liable to be attached to the photosensitive drum 1 first. Such small particles of charging carrier 23 are transferred by carrier attachment to be collected in the developing device 4 particularly at an initial stage of use of the image forming apparatus at which the total image forming time is short or the number of times the image forming operation has been repeated is small. It is, therefore, thought that the rate at which the apparent permeability of developer 43 changes is higher at an initial stage with respect to the passage of time from a start of use of the image forming apparatus or the number of times the image forming operation is repeated. Thereafter, as the amount of small particles of charging carrier 23 in the charging device 2 decreases, the rate at which the apparent permeability of developer 43 changes is gradually reduced. That is, it is thought that, as shown in FIG. 17, the permeability of developer 43 changes nonlinearly with respect to the operating time from a start of use of the image forming apparatus.

Figure 18:
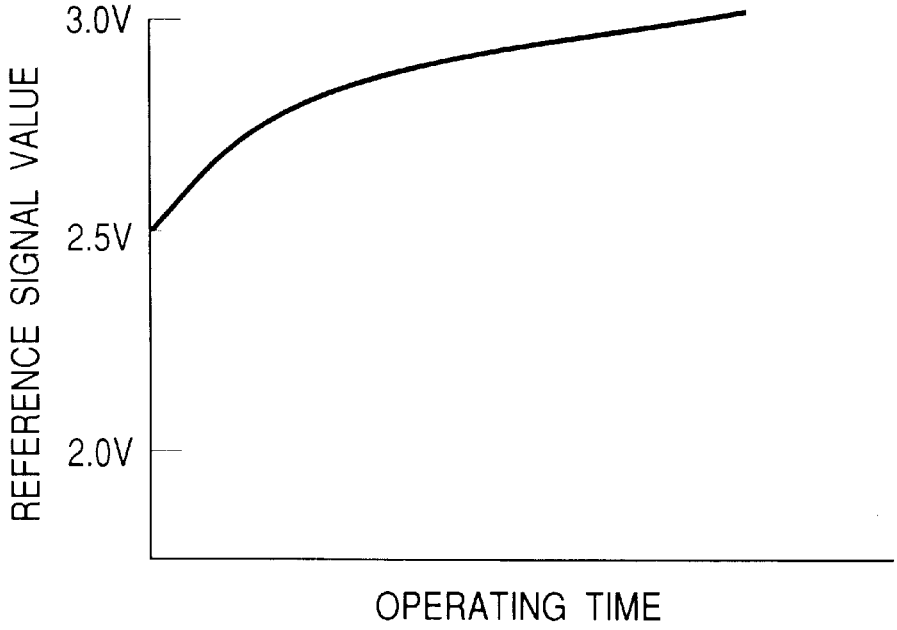
FIG. 18 is a diagram showing still another example of the relationship between the operating time of the image forming apparatus and the reference value for comparison with the detection signal from the inductance head under toner density control in accordance with the present invention.
Figure 19:
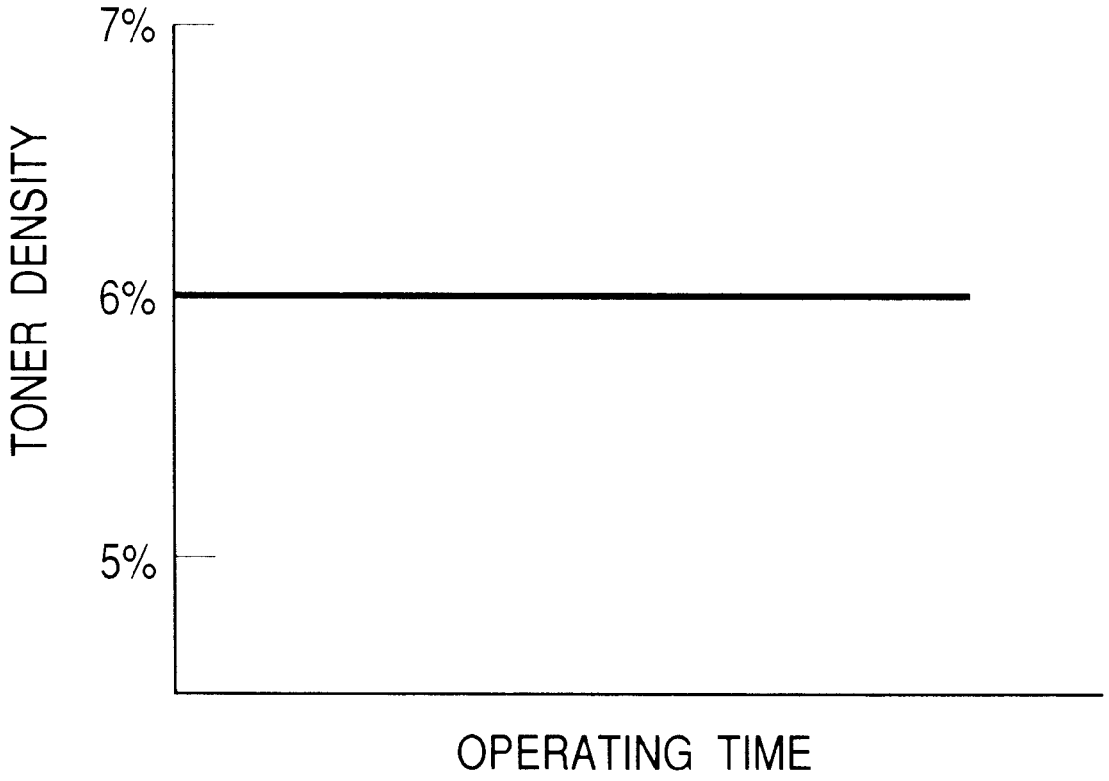
FIG. 19 is a diagram showing a further example of the relationship between the operating time of the image forming apparatus and the toner density under toner density control in accordance with the present invention.

In this embodiment, therefore, the reference signal value correcting means 35 is arranged to be newly set, with respect to each of different environments and each of the developing devices, the point at which the charging reference value of the detection signal from inductance head 30 according to the nonlinear change in the mixing amount of charging carrier 23 introducing into the developing device, obtained in advance in a suitable manner, as shown in FIG. 18. The arrangement may be such that, as in Embodiment 3, a rate at which the mixing amount of charging carrier 23 into each developing device 4 changes in each environment is determined with respect to time periods during which the developing device operates to form images at comparatively short intervals, a comparatively small video count in an image information signal, or a comparatively small number of times the image forming operation is repeated, or such that the nonlinear change in the mixing amount of charging carrier 23 is expressed by an equation using measured or computed values, and the reference voltage signal value is nonlinearly corrected according to this change with respect to each environment and each developing device.

In this manner, more accurate toner density control can always be achieved even if the mixing amount of charging carrier 23 into the developing device 4 changes as the image forming operation is repeated.

Each of the embodiments of the present invention has been described with respect to a case where the present invention is applied to an electrophotographic type of digital color copying machine. However, the present invention is not limited to this, and can be also be applied advantageously to any of other various image forming apparatuses, e.g., copying machines or printers using electrophotographic systems or electrostatic recording systems. For example, the present invention can be applied to an image forming apparatus which expresses light and shade by dithering or the like, and to an image forming apparatus in which a toner image is formed on the basis of an image information signal output from a computer or the like instead of copied data obtained from an original, namely a printer. Needless to say, various modifications and changes may be made according to one's need in construction or configuration of the image forming apparatuses and the control systems in accordance with the present invention.

Figure 20:
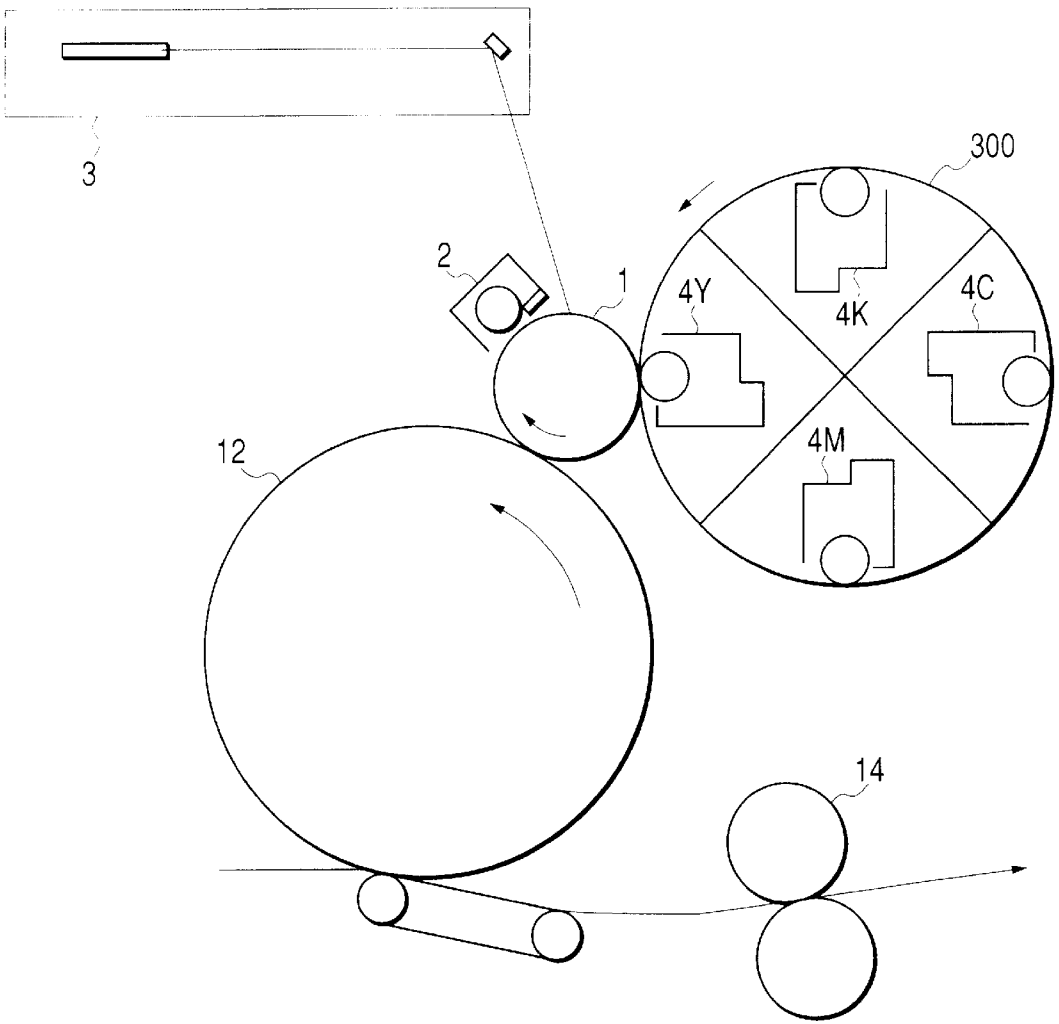
FIG. 20 is a diagram of another image forming apparatus to which the present invention is applied.

For example, the present invention can also be applied to an image forming apparatus such as shown in FIG. 20. Components of this apparatus having the same functions as those described above with respect to the embodiments are indicated by the same reference numerals and will not be described in detail. For example, the construction of the magnetic-brush-type charging device is the same as that shown in FIG. 3, the construction of each developing device is the same as that shown in FIG. 4, and the configuration of the toner density controller is also the same as that shown in FIG. 7.

The image forming apparatus shown in FIG. 20 is the same as the image forming apparatus shown in FIG. 1 with respect to use, for forming images, of plurality of developing. devices containing different developers (toner), but differs from the apparatus shown in FIG. 1 in that the developing devices point at which the charging sequentially form toner images on a photosensitive drum provided as a single image bearing member. The developing devices are mounted in a rotary device 300, which have the function of selectively moving the developing devices into a developing section.

In the image forming apparatus arranged as shown in FIG. 20, toner density control is also performed by setting different amounts of correction to target values in each of the developing devices for reasons described below.

Toners of different colors vary in triboelectricity (the amount of charge per unit weight for charging), so that corresponding developers differ from each other in bulk density. For this reason, inductance detection sensors produce different outputs when the same voltage is applied to the sensors. To equalize all the sensor outputs from the inductance sensors respectively provided in the developing devices (by setting them to, for example, 2.5 V), it is necessary to apply different voltages to the sensors in the developing devices. (For example, to obtain equal outputs of 2.5 V, biases to be applied to reference coils of the sensors are set to 10.5 (V) with respect to yellow and 10.2 (V) with respect to cyan.)

The reason for adjusting the outputs from the sensors in the developing devices to the same target value (reference value) relates to the sensitivity of the inductance detection sensors. The inductance sensors tend to be lower in sensitivity at a lower output level (in the vicinity of 0 V, for example) or at a higher level (in the vicinity of 5 V, for example), and it is preferable to set a center value in correspondence:with highest sensitivity (2.5 V, for example).

If equal amounts of charging magnetic particles separated from the magnetic-brush-type charging device mix into these developing devices, the sensor outputs change at different rates even with respect to the same amount of magnetic particles since the voltage applied to the sensors in the developing devices are different from each other. (For example, even in a case where equal amounts, e.g., 1 g of magnetic particles have mixed into the developing devices, the output changes at different rates since 10.5 (V) is applied to the sensor reference coil with respect to yellow and 10.2 (V) is applied with respect to cyan.)

For the above-described reasons, the control method of setting, with respect to the each of the developing devices (toners), different amounts of correction of target values (reference values) with which the sensor outputs are compared is also effective in the image forming apparatus shown in FIG. 20.

The image forming process performed by the image forming apparatus shown in FIG. 20 is outlined below briefly. First, toner images are formed on the photosensitive drum by the developing devices. The toner images are sequentially multilayer transferred by a primary transfer step to an intermediate transfer drum provided as an intermediate transfer member. The full-color toner image on the intermediate transfer drum is then collectively transferred onto a recording medium by a secondary transfer step.

Also with respect to the developing devices of the image forming apparatus shown in FIG. 20, the same effect as that in the above-described embodiments can be achieved by employing the above-described toner density controller.

What is claimed is:

1. An image forming apparatus comprising:

a plurality of image forming means for forming images in different colors, each of said plurality of image forming means including an image bearing member, charging means for charging said image bearing member, developing means for developing an electrostatic latent image formed on said image bearing member by a developer containing toner and a carrier, and detecting means for detecting information corresponding to a permeability of the developer in said developing means;

control means for controlling an amount of the developer supplied to each of said developing means according to an output from said detecting means and a corresponding target value, wherein each of said charging means includes magnetic particles, which are brought into contact with said image bearing member, a permeability of the magnetic particles being different from a permeability of the carrier; and correcting means for correcting each of the target values, wherein an amount of correction by said correcting means on correcting a target value corresponding to one detecting means of a plurality of said detecting means is different from an amount of correction by said correcting means on correcting a target value corresponding to another detecting means of said plurality of detecting means.

2. An apparatus according to claim 1, wherein correction timing by said correcting means on correcting the target value corresponding to said one detecting means of said plurality of detecting means is different from correction timing by said correcting means on correcting the target value corresponding to said another detecting means of said plurality of detecting means.

3. An apparatus according to claim 1, wherein correction timing by said correcting means can be changed according to an atmosphere condition in a main body of said image forming apparatus.

4. An apparatus according to claim 1, wherein each of said plurality of image forming means forms an image on a recording material.

5. An apparatus according to claim 4, wherein toner images on said image bearing members are sequentially transferred onto the recording material.

6. An apparatus according to claim 5, wherein the toner images on said image bearing members are sequentially transferred onto the recording material, which is borne on a recording material bearing member.

7. An apparatus according to claim 1, wherein toner images on said image bearing members are sequentially transferred onto an intermediate transfer member and are thereafter transferred from said intermediate transfer member to a recording material.

8. An apparatus according to any one of claims 1 to 7, wherein said correcting means corrects each of the target values according to an atmosphere condition in a main body of said image forming apparatus.

9. An apparatus according to claim 8, wherein the atmosphere condition comprises a temperature and a humidity detected by an atmosphere condition sensor.

10. An image forming apparatus comprising:

an image bearing member;

charging means for charging said image bearing member;

a plurality of developing means for developing electrostatic latent images formed on said image bearing member by developers respectively containing toners of different colors and carriers, each of said plurality of developing means including detecting means for detecting information corresponding to a permeability of developer in a corresponding one of said plurality of developing means;

control means for controlling an amount of the developer supplied to each of said plurality of developing means according to an output from said detecting means and a corresponding target value, wherein said charging means includes magnetic particles which are brought into contact with said image bearing member, a permeability of the magnetic particles being different from a permeability of the carrier; and correcting means for correcting each of the target values, wherein an amount of correction by said correcting means in correcting a target value corresponding to one detecting means of a plurality of said detecting means is different from an amount of correction by said correcting means in correcting a target value corresponding to another detecting means of said plurality of detecting means.

11. An apparatus according to claim 10, wherein correction timing by said correcting means in correcting the target value corresponding to said one detecting means of said plurality of detecting means is different from correction timing by said correcting means in correcting the target value corresponding to said another detecting means of said plurality of detecting means.

12. An apparatus according to claim 10, wherein correction timing by said correcting means is changeable in accordance with an atmosphere in a main body of said image forming apparatus.

13. An apparatus according to claim 10, wherein said image forming apparatus forms an image on a recording material.

14. An apparatus according to claim 13, wherein toner images on said image bearing member are sequentially transferred onto the recording material.

15. An apparatus according to claim 14, wherein the toner images on said image bearing member are sequentially transferred onto the recording material, which is borne on a recording material bearing member.

16. An apparatus according to claim 10, wherein toner images on said image bearing member are sequentially transferred onto an intermediate transfer member and are thereafter transferred from said intermediate transfer member to a recording material.

17. An apparatus according to any one of claims 10 to 16, wherein said correcting means corrects each of the target values in accordance with an atmosphere condition in a main body of said image forming apparatus.

18. An apparatus according to claim 17, wherein the atmosphere condition comprises a temperature and a humidity detected by an atmosphere condition sensor.

19. An image forming apparatus comprising:

an image bearing member;

charging means for charging said image bearing member;

developing means for developing an electrostatic latent image formed on said image bearing member by a developer containing toner and a carrier;

detecting means for detecting information corresponding to a permeability of the developer in said developing means;

control means for controlling an amount of the developer supplied to said developing means according to an output from said detecting means and a target value, wherein said charging means includes magnetic particles which are brought into contact with said image bearing member, a permeability of the magnetic particles being different from a permeability of the carrier; and correcting means for correcting the target value, wherein a correction timing by said correcting means is changeable in accordance with an atmosphere condition in a main body of said image forming apparatus.

20. An apparatus according to claim 19, wherein a toner image on said image bearing member is transferred onto a recording material.

21. An apparatus according to claim 20, wherein toner images on said image bearing member are sequentially transferred onto the recording material, which is borne on a recording material bearing member.

22. An apparatus according to claim 19, wherein a toner image on said image bearing member is transferred onto an intermediate transfer member and is thereafter transferred from said intermediate transfer member to a recording material.

23. An apparatus according to claim 19, wherein the atmosphere condition comprises a temperature and a humidity detected by an atmosphere condition sensor.

24. An image forming apparatus comprising:

an image bearing member;

charging means for charging said image bearing member;

developing means for developing an electrostatic latent image formed on said image bearing member by a developer containing toner and a carrier;

detecting means for detecting information corresponding to a permeability of the developer in said developing means;

control means for controlling an amount of the developer supplied to said developing means according to an output from said detecting means and a target value, wherein said charging means includes magnetic particles, which are brought into contact with said image bearing member, a permeability of the magnetic particles being different from a permeability of the carrier; and correcting means for correcting the target value, wherein said correcting means increases the target value each time said correcting means performs a correction.

25. An apparatus according to claim 24, wherein a toner image on said image bearing member is transferred onto a recording material.

26. An apparatus according to claim 25, wherein toner images on said image bearing member are sequentially transferred onto the recording material, which is borne on a recording material bearing member.

27. An apparatus according to claim 24, wherein a toner image on said image bearing member is transferred onto an intermediate transfer member and is thereafter transferred from said intermediate transfer member to a recording material.

28. An apparatus according to claim 24, wherein an atmosphere condition comprises a temperature and a humidity detected by an atmosphere condition sensor.

* * * * *

UNITED STATES PATENT AND TRADEMARK OFFICE

CERTIFICATE OF CORRECTION

PATENT NO. : 6,501,916 B2
DATED : December 31, 2002
INVENTOR(S) : Hideaki Suzuki It is certified that error appears in the above-identified patent and that said Letters Patent is hereby corrected as shown below:

Column 2,
Line 5, “signal.” should read -- signal --.

Column 3,
Line 18, “the:” should read -- the --.

Column 4,
Line 25, “as:” should read -- as --.

Column 5,
Line 57, “mixes” should read -- mix --.

Column 7,
Line 51, “ffered” should read -- ferred --.

Column 9,
Line 19, “device 2” should read -- device 2, and --; and
Line 39, “the,” should read -- the --.

Column 10,
Line 64, “main, pole” should read -- main pole --.

Column 11,
Line 34, “potential, cannot” should read -- potential cannot --.

Column 12,
Line 27, “development.” should read -- development --.

Column 13,
Line 19, “means)as” should read -- means) as --.

Column 14,
Line 17, “densimeter.” should read -- densitometer. --.

Column 19,
Line 20, “mixeses” should read -- mixes --.

Column 20,
Line 64, “the:” should read -- the --.

UNITED STATES PATENT AND TRADEMARK OFFICE

CERTIFICATE OF CORRECTION

PATENT NO. : 6,501,916 B2 
DATED : December 31, 2002
INVENTOR(S) : Hideaki Suzuki It is certified that error appears in the above-identified patent and that said Letters Patent is hereby corrected as shown below:

Column 22,
Line 14, ": eliminating" should read -- eliminating --.

Column 23,
Line 7, "correction." should read -- correction --.

Column 25,
Line 34, "ing." should read -- ing --; and
Line 66, "correspondence: with" should read -- correspondence with --.

Column 27,
Line 41, "particles" should read -- particles, --; and
Line 63, "atmosphere" should read -- atmosphere condition --.

Signed and Sealed this

First Day of July, 2003

JAMES E. ROGAN
*Director of the United States Patent and Trademark Office*